US010395815B2

(12) United States Patent
Yang et al.

(10) Patent No.: US 10,395,815 B2
(45) Date of Patent: Aug. 27, 2019

(54) MAGNETIC DEVICE

(71) Applicant: Delta Electronics, Inc., Taoyuan, Taiwan (CN)

(72) Inventors: Haijun Yang, Taoyuan (CN); Chunmei Wang, Taoyuan (CN); Chen Zeng, Taoyuan (CN); Zengyi Lu, Taoyuan (TW); Jinfa Zhang, Taoyuan (CN)

(73) Assignee: Delta Electronics, Inc., Taoyuan, Taiwan (CN)

( * ) Notice: Subject to any disclaimer, the term of this patent is extended or adjusted under 35 U.S.C. 154(b) by 0 days.

(21) Appl. No.: 16/047,015

(22) Filed: Jul. 27, 2018

(65) Prior Publication Data

US 2018/0350512 A1 Dec. 6, 2018

Related U.S. Application Data

(63) Continuation-in-part of application No. 14/884,785, filed on Oct. 16, 2015, now Pat. No. 10,068,696.

(30) Foreign Application Priority Data

Jan. 22, 2015 (CN) ..... 2015 1 0032555
Feb. 1, 2018 (CN) ..... 2018 2 0180824 U

(51) Int. Cl.
*H01F 27/02* (2006.01)
*H01F 27/28* (2006.01)
(Continued)

(52) U.S. Cl.
CPC ..... *H01F 27/2876* (2013.01); *H01F 27/02* (2013.01); *H01F 27/22* (2013.01);
(Continued)

(58) Field of Classification Search
CPC ..... H01F 27/22; H01F 27/306; H01F 27/325
(Continued)

(56) References Cited

U.S. PATENT DOCUMENTS 3,668,586 A * 6/1972 Horbach ..... H01F 27/263 336/210
4,352,080 A * 9/1982 Mitsui ..... H01F 17/04 336/233
4,549,158 A * 10/1985 Mitsui ..... H01F 5/02 336/192
5,028,904 A * 7/1991 Kurano ..... H01F 27/022 336/205
5,489,884 A * 2/1996 Heringer ..... H01F 17/041 336/210
(Continued)

FOREIGN PATENT DOCUMENTS

CN 1731543 A 2/2006
CN 203675506 U 6/2014

OTHER PUBLICATIONS

The Notice of Allowance issued by CNIPA dated Aug. 3, 2018.

*Primary Examiner* — Ronald Hinson
(74) *Attorney, Agent, or Firm* — Yunling Ren

(57) ABSTRACT

A magnetic device includes a housing, a bobbin, at least one coil, and a first magnetic core and a second magnetic core. The housing has at least one side plate and a bottom plate. The side plate stands on the bottom plate and forms a space with the bottom plate. The bobbin is at least partially located in the space. The bobbin has a cylinder. The at least one coil is wound around the cylinder. Each of the first and second magnetic cores includes a center column, a side column, a connecting portion, and a metal clip. The center column is located in the cylinder. The side column is located outside the coil and away from the bottom plate, such that the coil is located between the side column and the bottom plate. The connecting portion connects the center column and the side column.

20 Claims, 21 Drawing Sheets

(51) Int. Cl.

| | |
|---|---|
| ***H01F 27/22*** | (2006.01) |
| ***H01F 27/30*** | (2006.01) |
| ***H01F 27/32*** | (2006.01) |
| ***H01F 27/24*** | (2006.01) |
| ***H01F 27/26*** | (2006.01) |
| ***H01F 27/38*** | (2006.01) |
| *H01F 27/29* | (2006.01) |

(52) U.S. Cl.
CPC ..... *H01F 27/24* (2013.01); *H01F 27/26* (2013.01); *H01F 27/2823* (2013.01); *H01F 27/303* (2013.01); *H01F 27/306* (2013.01); *H01F 27/325* (2013.01); *H01F 27/38* (2013.01); *H01F 27/29* (2013.01)

(58) Field of Classification Search
USPC ..... 336/90
See application file for complete search history.

(56) References Cited

U.S. PATENT DOCUMENTS

| | | | | | |
|---|---|---|---|---|---|
| 5,592,138 | A * | 1/1997 | Tobben | H01F 27/263 | 336/210 |
| 5,635,891 | A * | 6/1997 | Miyoshi | H01F 5/02 | 336/198 |
| 5,831,505 | A * | 11/1998 | Yamaguchi | H01F 27/027 | 336/83 |
| 6,154,113 | A * | 11/2000 | Murai | H01F 27/2828 | 336/192 |
| 6,501,362 | B1 * | 12/2002 | Hoffman | H01F 17/043 | 336/192 |
| 2003/0020582 | A1 * | 1/2003 | Naito | H01F 38/42 | 336/198 |
| 2014/0160644 | A1 * | 6/2014 | Nam | H05K 5/02 | 361/679.01 |

* cited by examiner

MAGNETIC DEVICE

RELATED APPLICATIONS

The present disclosure is a Continue-in-part application of U.S. application Ser. No. 14/884,785 which claims priority to China Application Serial Number 201510032555.9, filed Jan. 22, 2015, and the present application claims priority to China Application Serial Number 201820180824.5, filed Feb. 1, 2018, which are herein incorporated by reference.

BACKGROUND

Field of Disclosure

The present disclosure relates to a magnetic device.

Description of Related Art

Magnetic devices (such as inductors or transformers) are core electrical devices in power supply equipment, but at the same time, they are bulky and heavy. Temperatures of magnetic devices tend to rise when they are operating because of their high losses and difficulties in heat dissipation. Since a thermal expansion coefficient of magnetic cores is not consistent with thermal expansion coefficients of other components in the magnetic devices and a material of the magnetic cores is hard and brittle, magnetic cores will be squeezed by other components when temperature rises, which causes the magnetic cores fracture so the reliability is reduced.

For the forgoing reasons, there is a need to solve the above-mentioned problems by providing a magnetic device having a high reliability.

SUMMARY

One aspect of the present disclosure is to provide a magnetic device. The magnetic device has a good heat dissipation structure and is able to effectively avoid that the magnetic core fractures because of being squeezed by other components in the magnetic device so as to resolve the above-mentioned problems.

A magnetic device is provided. The magnetic device comprises: a housing having at least one side plate and a bottom plate, the side plate standing on the bottom plate and forming a space with the bottom plate; a bobbin at least partially located in the space, the bobbin having a cylinder; at least one coil wound around the cylinder; and a first magnetic core and a second magnetic core. Each of the first and second magnetic cores comprises: a center column located in the cylinder; a side column located on an outer side of the coil being opposite to the bottom plate, such that the coil is located between the side column and the bottom plate; and a connecting portion connecting the center column and the side column, wherein the first magnetic core and the second magnetic core are arranged on two sides of the bobbin, respectively, and the side column of the first magnetic core and the side column of the second magnetic core form an outer side surface at a side away from the bobbin. The magnetic device further comprises a metal clip provided at the outer side surface for clamping the first magnetic core and the second magnetic core so that the first and second magnetic cores fit together. In summary, according to the magnetic device of the above embodiments, the portion of the coil facing the bottom plate of the housing can transfer heat to the housing directly and the heat dissipated through the heat dissipation device connected to the outside of the housing. Hence, the magnetic device according to the above embodiments has good heat dissipation ability. Additionally, since the portion of the coil facing the bottom plate is not constrained by the magnetic cores, the magnetic cores at most are displaced rather than are fractured or are damaged because of being squeezed when the temperature of the magnetic device rises during operation.

It is to be understood that both the foregoing general description and the following detailed description are by examples, and are intended to provide further explanation of the disclosure as claimed.

DESCRIPTION OF THE EMBODIMENTS

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and components are schematically depicted in order to simplify the drawings.

Figure 1:
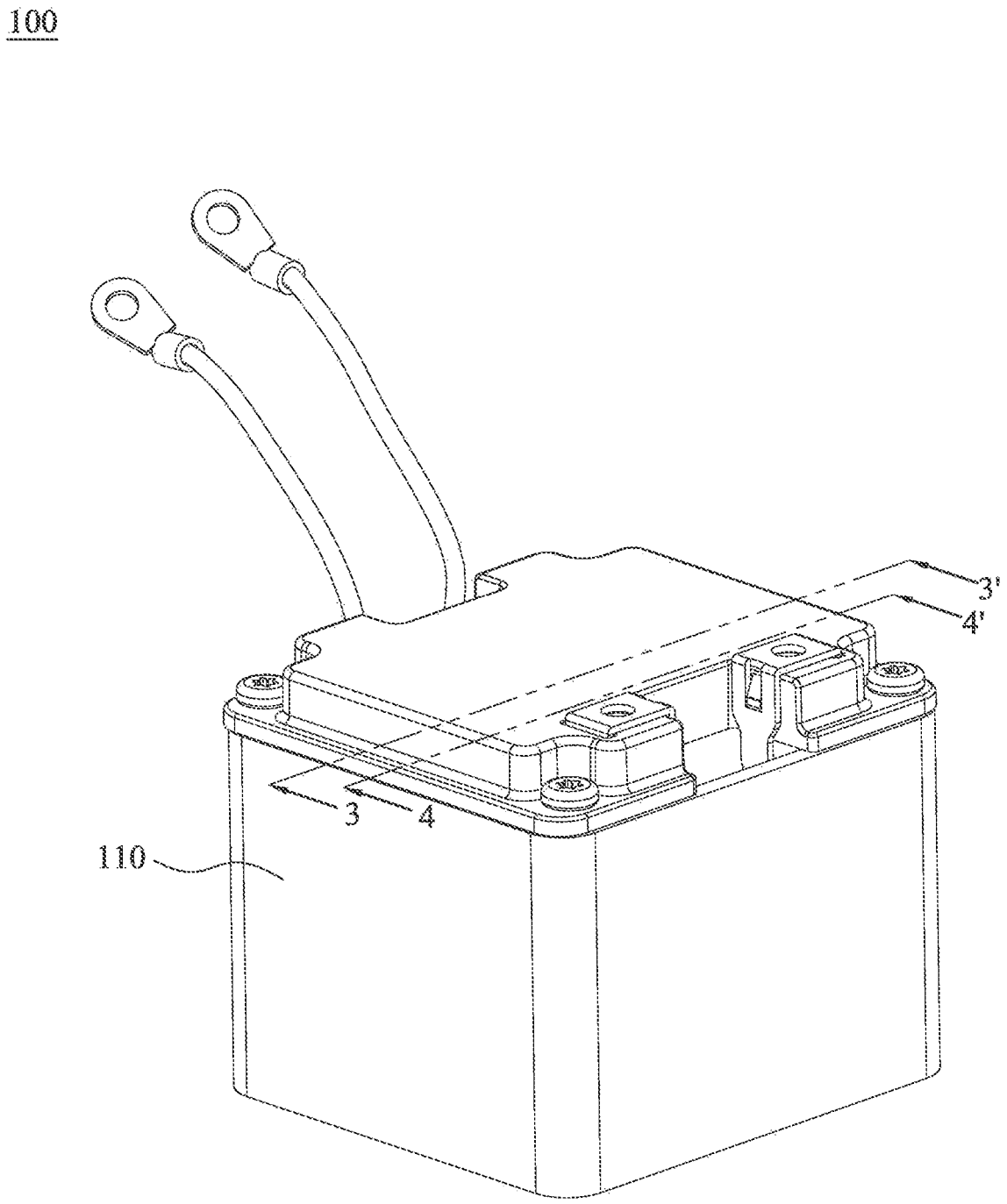
FIG. 1 depicts an assembly diagram of a magnetic device according to one embodiment of this disclosure.
Figure 2:
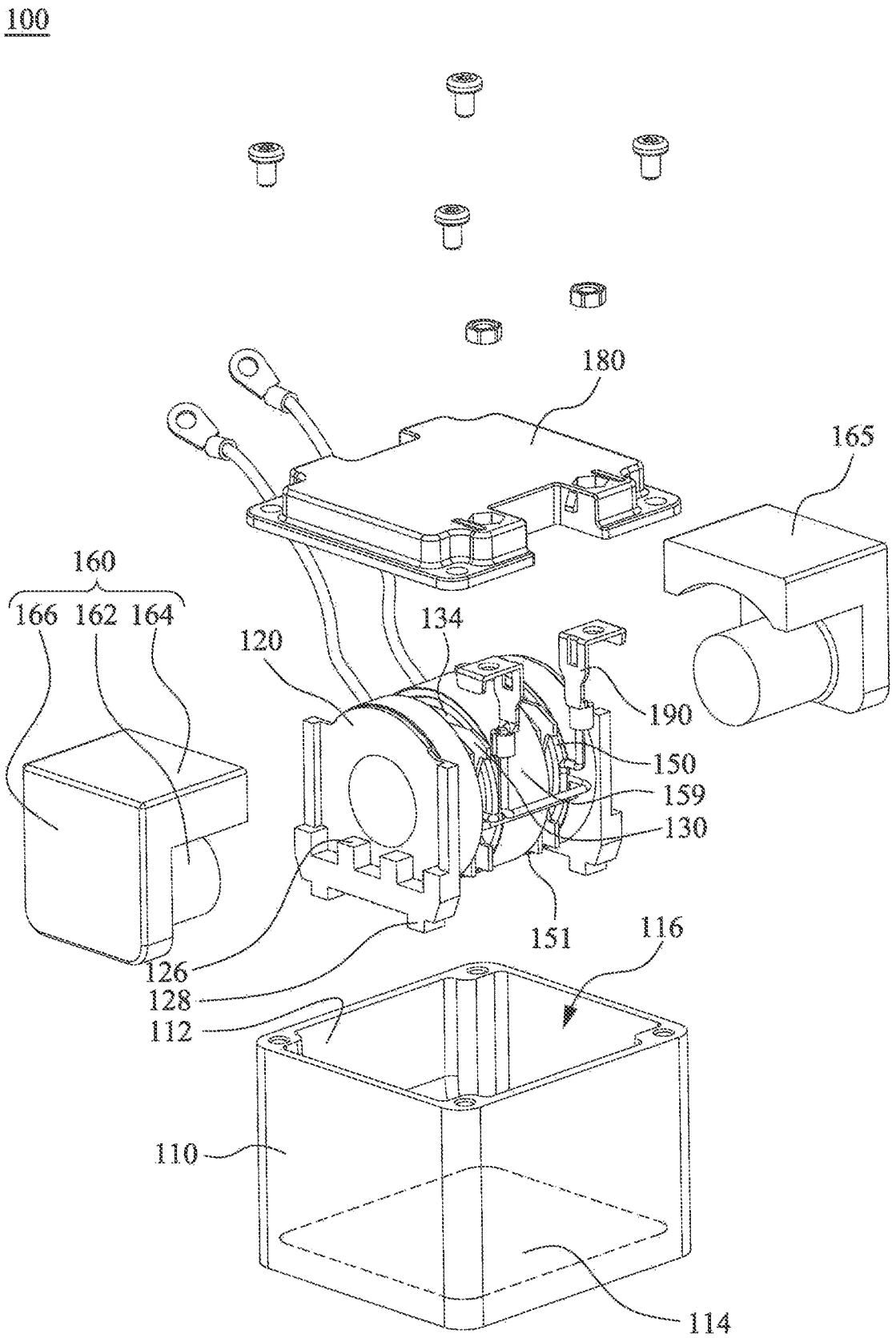
FIG. 2 depicts an exploded view of the magnetic device in FIG. 1.

FIG. 1 depicts an assembly diagram of a magnetic device 100 according to one embodiment of this disclosure FIG. 2 depicts an exploded view of the magnetic device 100 in FIG. 1. And FIG. 3 depicts a cross-sectional view taken along line 3-3' of FIG. 1.

Figure 3:
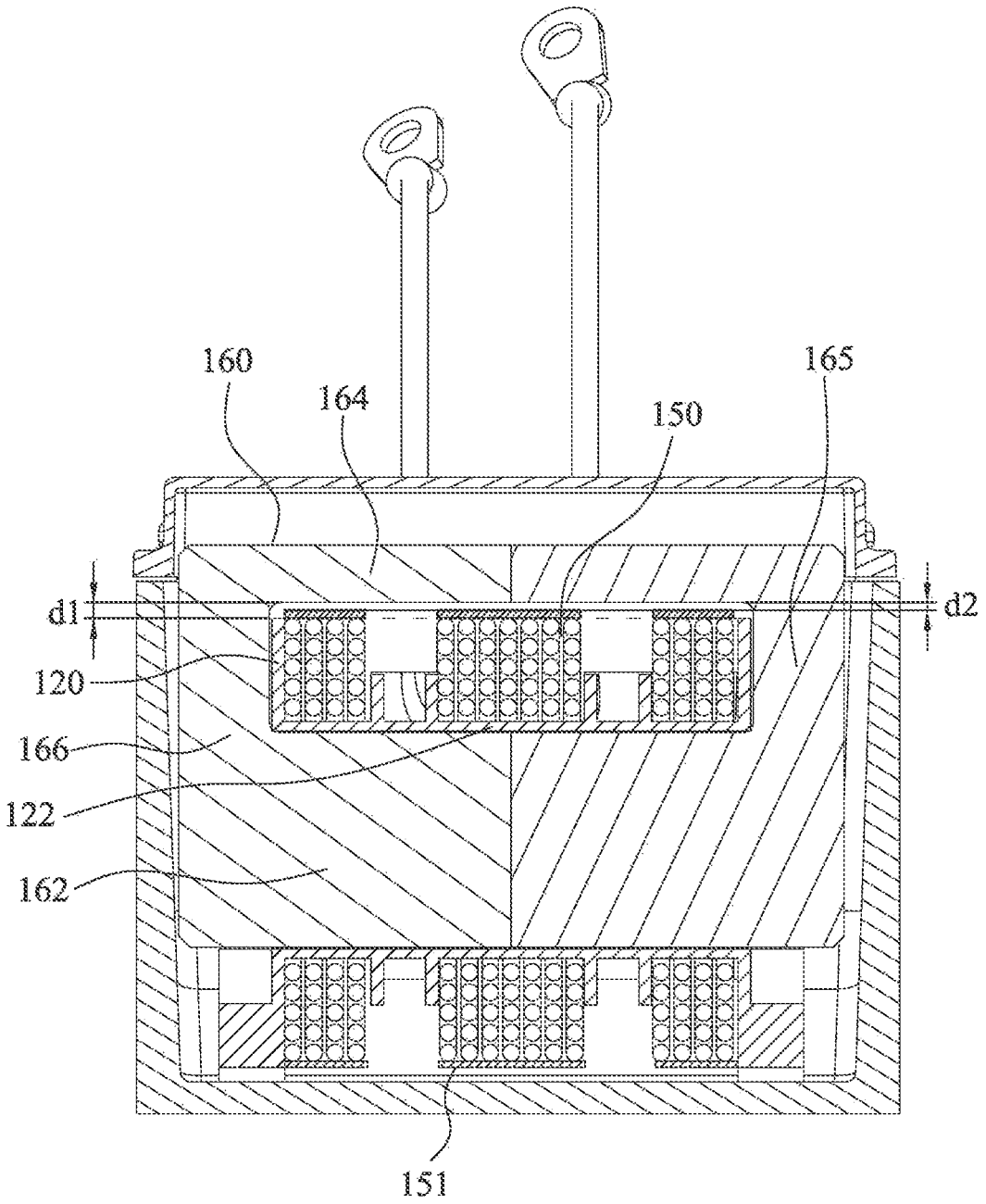
FIG. 3 depicts a cross-sectional view taken along line 3-3' of FIG. 1.

As shown in FIG. 1 to FIG. 3, in the present embodiment, the magnetic device 100 includes a housing 110, a bobbin 120, a coil 150, and a first magnetic core 160. The housing 110 has a side plate 112 and a bottom plate 114. The side plate 112 stands on the bottom plate 114 and forms a space 116 with the bottom plate 114 between the side plate 112 and the bottom plate 114. The bobbin 120 is at least partially located in the space 116. The bobbin 120 has a cylinder 122. The coil 150 is wound around the cylinder 122 of the bobbin 120. The coil 150 has a portion 151 facing the bottom plate 114. According to the present embodiment, the coil 150 further includes an insulating tape 159 on an outer surface of the coil 150 for fixing the coil 150. The first magnetic core 160 includes a center column 162, a side column 164, and a connecting portion 166. The center column 162 is located in the cylinder 122. In the present embodiment, the magnetic device 100 may further include a second magnetic core 165. The first magnetic core 160 and the second magnetic core 165 may be symmetrical to each other and are inserted into the bobbin 120 respectively from a left side and right side of. However, the present disclosure is not limited in this regard. The first magnetic core 160 and the second magnetic core 165 may be not symmetrical to each other, or are integrally formed. According to the present embodiment, the side column 164 is located on an outer side of the coil 150 being opposite to the bottom plate 114, such that the coil 150 is located between the side column 164 and the bottom plate 114. In other embodiments, the relative position of the side column 164 may be selected depending on engineering requirements. The connecting portion 166 connects the center column 162 and the side column 164.

In the present embodiment, the portion 151 of the coil 150 facing the bottom plate 114 is not covered by the first magnetic core 160 and the second magnetic core 165. That is, the portion 151 of the coil 150 facing the bottom plate 114 will directly transfer heat to the bottom plate 114 through a heat transfer medium (not shown in the figures, such as air, cooling oil, or heat conductive glue). In this manner, the portion 151 of the coil 150 facing the bottom plate 114 can transfer heat to the housing 110 directly and the heat is dissipated through a heat dissipation device (not shown in the figures) connected to an outside of the housing 110. Hence, the magnetic device 100 according to the present embodiment has good heat dissipation ability.

In greater detail, since the portion 151 of the coil 150 facing the bottom plate 114 is not constrained by the first magnetic core 160 and the second magnetic core 165, the first magnetic core 160 and the second magnetic core 165 at most are displaced rather than are fractured or are damaged because of being squeezed even though the heated coil 150 and heat transfer medium expand when a temperature of the magnetic device 100 rises during operation. As a result, the present embodiment magnetic device 100 can effectively overcome the magnetic core fracture problem caused by increased temperature.

It should be understood that although the portion 151 is not covered by any magnetic core in FIG. 1 to FIG. 3, however, the present disclosure is not limited in this regard. In some embodiments of the present disclosure, the portion 151 may be covered by another magnetic core rather than the first magnetic core 160 and the second magnetic core 165. In fact, as long as the magnetic core covering the portion 151 is not physically connected to the first magnetic core 160 and the second magnetic core 165, the first magnetic core 160, the second magnetic core 165, and even the magnetic core covering the portion 151 at most are displaced rather than are fractured or are damaged because of being squeezed even though the heated coil 150 is heated to expand.

As shown in FIG. 2 and FIG. 3, in the present embodiment, a gap d1 exists between the bobbin 120 and the side column 164. The center column 162 can be inserted into the cylinder 122 such that the first magnetic core 160 is supported. The bobbin 120 may further include an abutment portion 126 (see FIG. 2). The abutment portion 126 is located on one side of the bobbin 120 and allows the connecting portion 166 to abut it. The first magnetic core 160 is supported through the abutment of the abutment portion 126 of the bobbin 120 by the connecting portion 166 to allow the gap d1 to exist between the side column 164 of the first magnetic core 160 and the bobbin 120. That is, the side column 164 of the first magnetic core 160 does not abut the bobbin 120. Hence, after the heated bobbin 120 expands, the bobbin 120 will not squeeze the side to column 164 due to the gap d1 between the bobbin 120 and the side column 164 so as to avoid that the side column 164 fractures because of being squeezed by the bobbin 120. In the prior art, it is usually expected that the gap d1 is as small as possible to reduce the overall size of the magnetic device. In order to avoid that the side column 164 fractures because of being squeezed by the bobbin 120, a larger gap d1 is reserved in the present embodiment. For example, the gap d1 is not less than 0.2 millimeter (mm) according to the present disclosure.

As shown in FIG. 3, a gap d2 exists between the coil 150 and the side column 164 according to the present embodiment. After the heated coil 150 is heated to expand, the coil 150 will not squeeze the side column 164 due to the gap d2 between the coil 150 and the side column 164 so as to avoid that the side column 164 fractures because of being squeezed by the coil 150.

Figure 4:
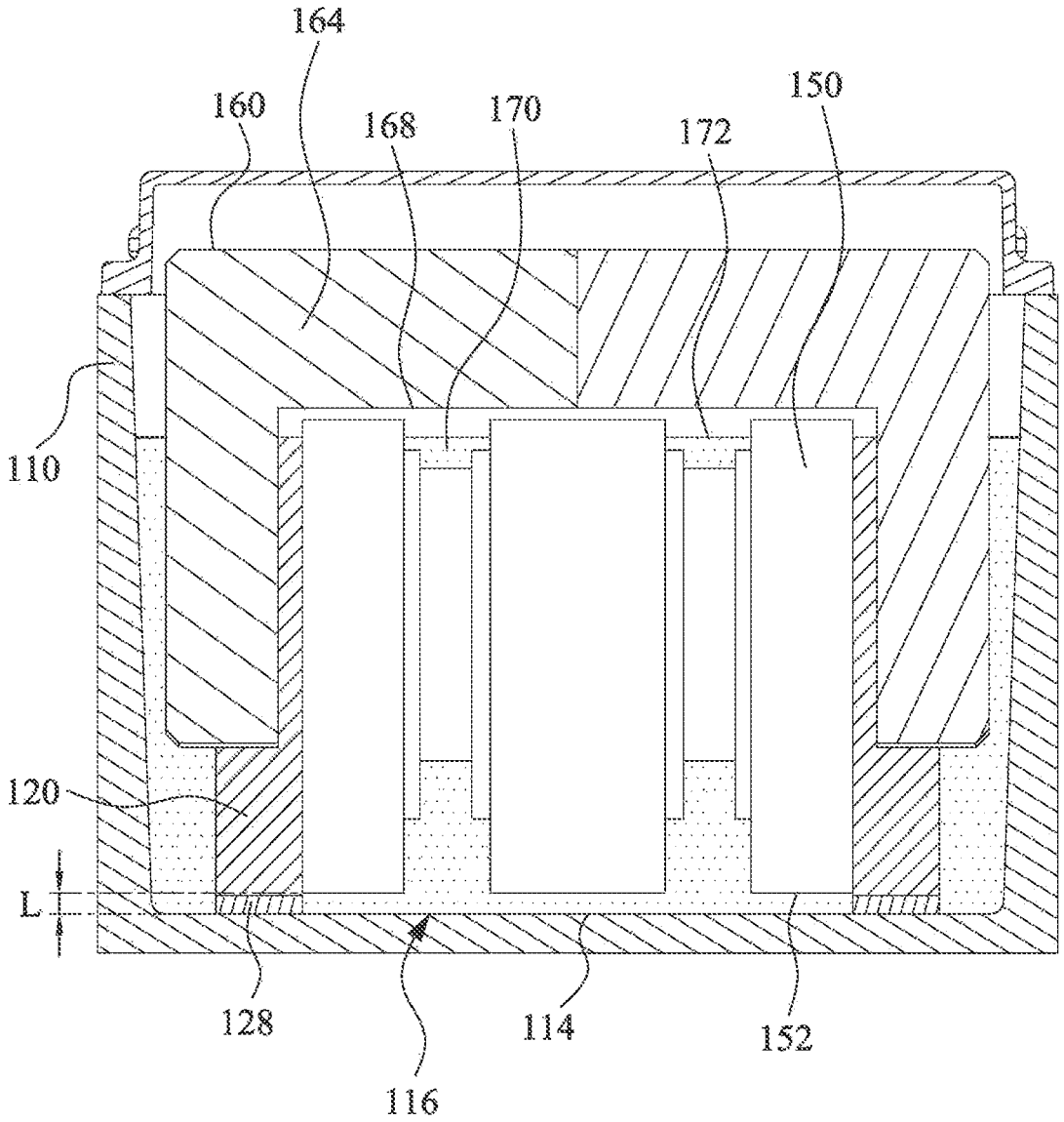
FIG. 4 depicts a cross-sectional view taken along line 4-4' of FIG. 1.

FIG. 4 depicts a cross-sectional view taken along line 4-4' of FIG. 1 in which the coil 150 is not dissected.

As shown in FIG. 2 and FIG. 4, in the present embodiment, the magnetic device 100 further includes a heat conductive glue 170 potted into the space 116. The heat conductive glue 170 will solidify to become a solid after being potted into the space 116. The heat conductive glue 170 has a function of thermal conduction, such that heat generated by the coil 150 and other components can be conducted to the housing 110 and heat is dissipated through the heat dissipation device (not shown in the figures) connected to the outside of the housing 110. Since the heat conductive glue 170 will become solid after solidification, the components in the magnetic device 100 (such as the bobbin 120 and the coil 150, etc.) can be effectively fixed, such that they will not collide with one another in an inside of the housing 110 because of vibrations of the magnetic device 100. In addition, the heat conductive glue 170 still retains flexibility even has become the solid after solidification. The heat conductive glue 170 is thus able to absorb the impact force caused by the vibrations effectively to protect the components in the magnetic device 100 when the magnetic device 100 vibrates.

According to the present embodiment, the side column 164 of the first magnetic core 160 has a column surface 168 closest to the center column 162. A fluid level 172 of the heat conductive glue 170 is between the bottom plate 114 and the column surface 168. Here the fluid level 172 of the heat conductive glue 170 refers to a farthest surface of the heat conductive glue 170 relative to the bottom plate 114. The fact that the fluid level 172 of the heat conductive glue 170 is between the bottom plate 114 and the column surface 168 means that a height of the heat conductive glue 170 does not exceed the column surface 168 of the side column 164. Hence, after the heated heat conductive glue 170 expands, the heat conductive glue 170 will not squeeze the side column 164 to cause fracture in the side column 164.

As shown in FIG. 2 and FIG. 4, the magnetic device 100 further includes a protruding member 128 according to the present embodiment. The protruding member 128 is disposed on the bobbin 120 and configured for abutting the bottom plate 114. The coil 150 has a coil outer surface 152. The protruding member 128 abuts the bottom plate 114, such that a spacing L exists between the coil outer surface 152 and the bottom plate 114. In other words, the protruding member 128 is used for lifting the bobbin 120 so that the coil 150 does not directly contact the bottom plate 114 to prevent the coil 150 or the bobbin 120 from being squeezed, or even been damaged, by the bottom plate 114 owing to the vibrations of the magnetic device 100. In another embodiment, the heat conductive glue 170 is disposed between the coil outer surface 152 and the bottom plate 114 to serve as a buffer layer. The anti-vibration effect is thus even better. In still another embodiment of the present disclosure, a spacing between the coil outer surface and the bottom plate may be realized through another method.

Figure 5:
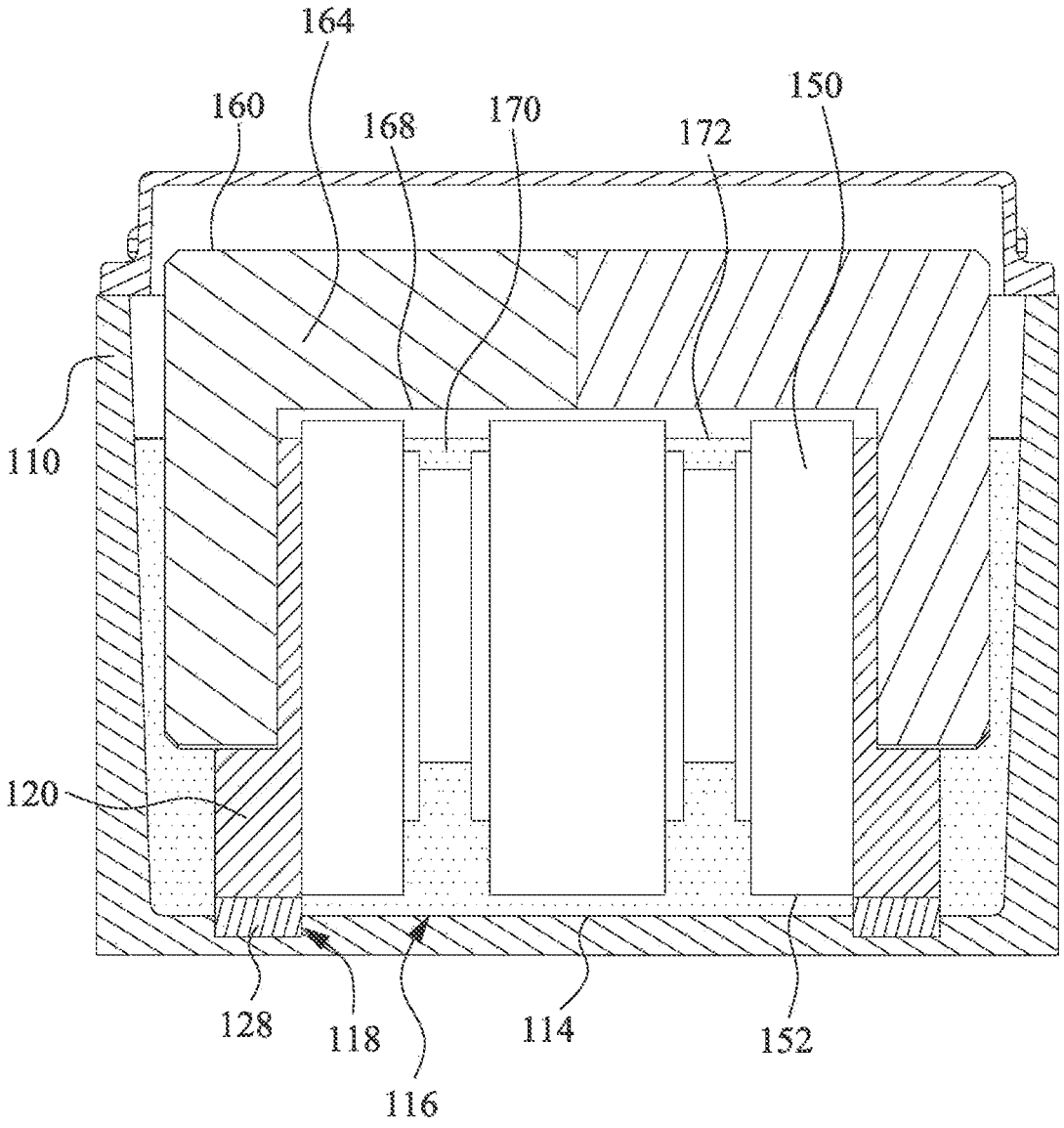
FIG. 5 depicts a cross-sectional view of a magnetic device according to another embodiment of this disclosure.

FIG. 5 depicts a cross-sectional view of the magnetic device 100 according to another embodiment of this disclosure in which a cross-sectional position is the same as that in FIG. 4 and the coil 150 is not dissected.

As shown in FIG. 5, in the present embodiment, the magnetic device 100 includes the protruding member 128 disposed on the bobbin 120. The housing 110 has a positioning recess 118 on the bottom plate 114. The protruding member 128 is engaged with the positioning recess 118. Hence, when an assembler places the bobbin 120 around which the coil 150 has been wound into the housing 110, rapid positioning can be achieved by utilizing the protruding member 128 and the positioning recess 118. In addition, after the bobbin 120 has been placed into the housing 110, the bobbin 120 can be fixed and positioned by the protruding member 128 and the positioning recess 118 even when the magnetic device 100 vibrates so as to avoid collisions.

Figure 6:
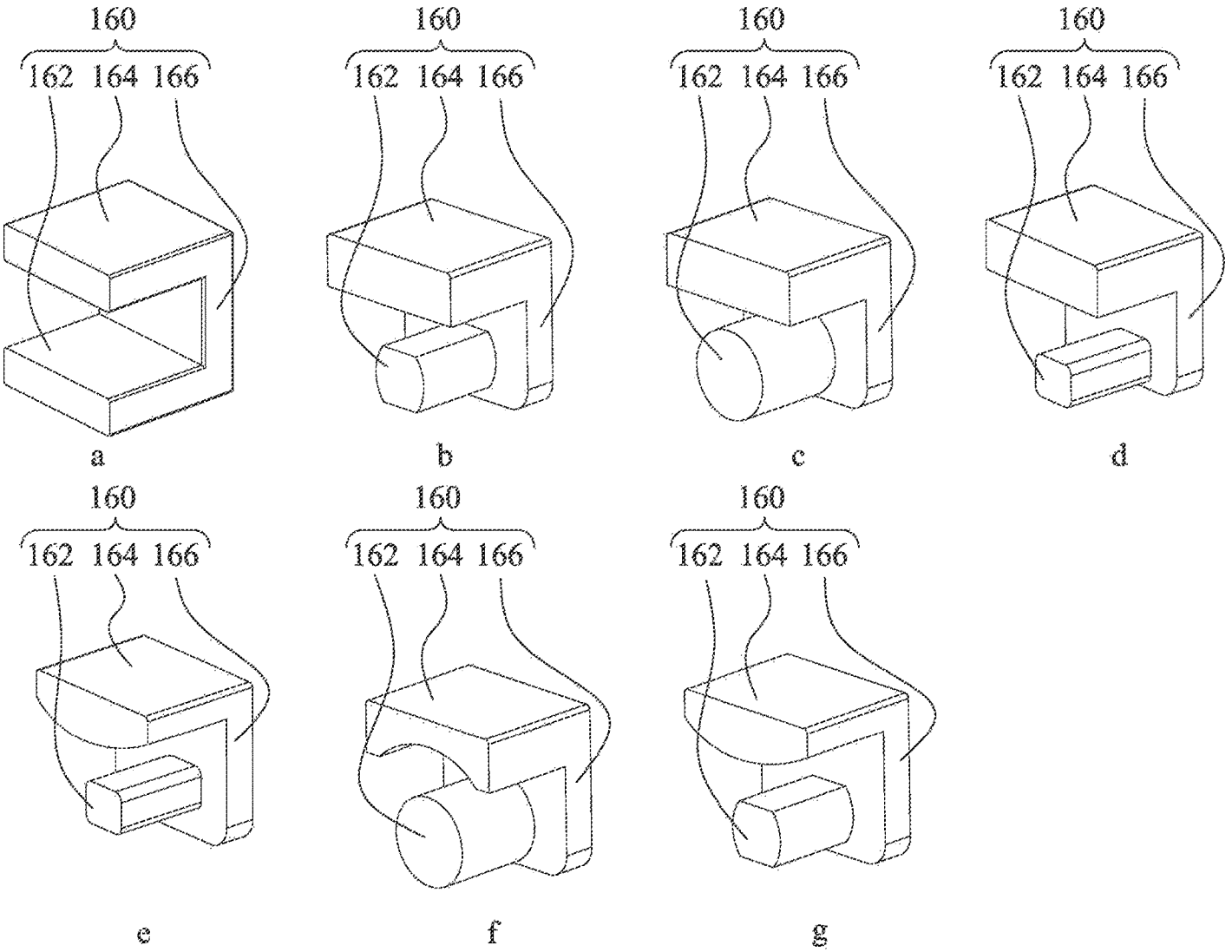
FIG. 6 depicts a perspective view of the first magnetic core in FIG. 2.

FIG. 6 depicts a perspective view of the first magnetic core 160 in FIG. 2. The second magnetic core 165 in FIG. 2 may be symmetrical to the first magnetic core 160 or not symmetrical to the first magnetic core 160. As shown in FIG. 6, each of the center column 162 and the side column 164 of the first magnetic core 160 may be in a circular shape, in a square shape, in a rectangular shape, in a trapezoidal shape, in an elliptical shape, in an irregular shape, or in a shape of combinations thereof. As shown in figure f of FIG. 6, the side column 164 is in an arcuate shape. Also, in other embodiment, the side column 164 may be in the circular shape, in the square shape, in the rectangular shape, in the trapezoidal shape, in the elliptical shape, in the irregular shape, or in the shape of combinations thereof. As shown in figure b of FIG. 6, the center column 162 is in a shape of a combination of a square and a semicircle. In another embodiment of the present disclosure, shapes of the center column 162 and the side column 164 are not limited.

As shown in figure c and figure f of FIG. 6, the center column 162 is in a shape of a circular cylinder according to the present embodiment. Since the center column 162 is in the shape of the circular cylinder, the cylinder 122 (see FIG. 9) of the bobbin 120 is fabricated to be in the shape of the circular cylinder correspondingly to allow the coil 150 (see FIG. 9) to wind around it. Under the circumstances of a same magnetic flux, a winding length of the coil 150 is the shortest, and an equivalent resistance and a loss are the lowest if the cylinder 122 of the bobbin 120 is in the shape of the circular cylinder.

As shown in figure a, figure d, and figure e of FIG. 6, the center column 162 is in a shape of a rectangular parallelepiped according to the present embodiment. Designing the center column 162 to be in the shape of the rectangular parallelepiped would facilitate the manufacturing process of the first magnetic core 160 so as to reduce the manufacturing cost.

According to an embodiment, the shape of the cylinder 122 of the bobbin 120 is fabricated to be in the shape of the center column 162 to assemble easily.

Figure 7:
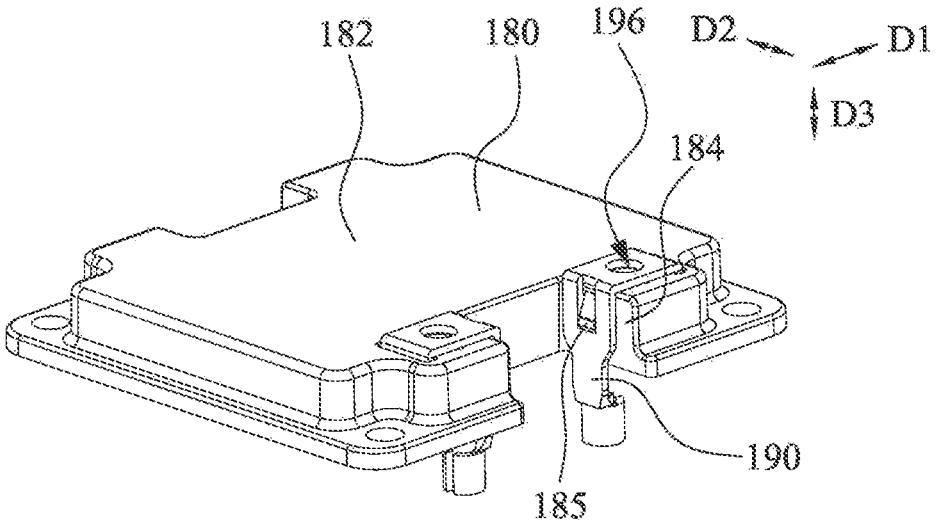
FIG. 7 depicts an assembly diagram of a top cover and connecting terminals in FIG. 2.
Figure 8:
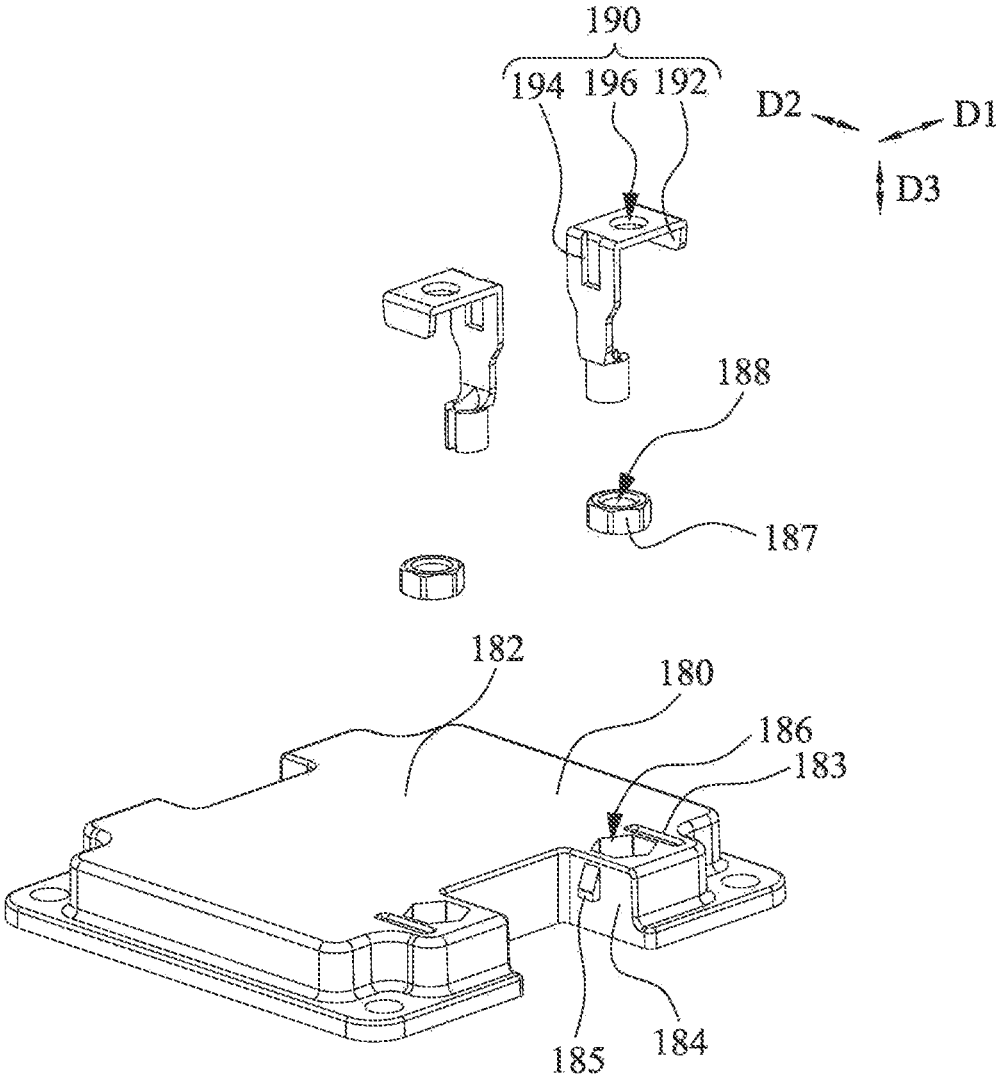
FIG. 8 depicts an exploded view of the top cover and the connecting terminals in FIG. 7.

FIG. 7 depicts an assembly diagram of a top cover 180 and connecting terminals 190 in FIG. 2. FIG. 8 depicts an exploded view of the top cover 180 and the connecting terminals 190 in FIG. 7.

As shown in FIG. 7 and FIG. 8, the magnetic device 100 (see FIG. 2) further includes the top cover 180 and the connecting terminals 190 according to the present embodiment. The top cover 180 is used for covering the housing 110 (see FIG. 2) and is located on a side opposite to the bottom plate 114 (see FIG. 2). The top cover 180 has a first surface 182 and a second surface 184 adjacent to each other, and a normal direction of the first surface 182 crosses a normal direction of the second surface 184. The top cover 180 includes first engaging portions 183 and second engaging portions 185. The first engaging portions 183 are located on the first surface 182. The second engaging portions 185 are located on the second surface 184. The connecting terminals 190 are electrically connected to the coil 150 (see FIG. 2) and serve as interfaces for connecting external circuits. Each of the connecting terminals 190 includes a third engaging portion 192 and a fourth engaging portion 194. The third engaging portions 192 are detachably engaged with the first engaging portions 183 so as to constrain degrees of freedom of the connecting terminals 190 in a first direction D1 and a second direction D2. The fourth engaging portions 194 are detachably engaged with the second engaging portions 185 so as to constrain a degree of freedom of the connecting terminals 190 in a third direction D3. The first direction D1, the second direction D2, and the third direction D3 are linearly independent of one another.

As shown in FIG. 8, the first engaging portions 183 may be concave engaging portions, and the third engaging portions 192 may be convex engaging portions. With their shapes matching each other, the first engaging portions 183 and the third engaging portions 192 can be engaged with each other detachably. Additionally, the degrees of freedom of the connecting terminals 190 in the first direction D1 and the second direction D2 are also constrained through constraining degrees of freedom of the third engaging portions 192 in the first direction D1 and the second direction D2. It should be understood that the above-mentioned concave shape and convex shape that match each other only serve as an example and are not intended to limit the present disclosure.

As shown in FIG. 8, the second engaging portions 185 may be convex engaging portions, and the fourth engaging portions 194 may be concave engaging portions. Similarly, with their shapes matching each other, the second engaging portions 185 and the fourth engaging portions 194 can be engaged with each other detachably. Additionally, the degree of freedom of the connecting terminals 190 in the third direction D3 is also constrained through constraining a degree of freedom of the fourth engaging portions 194 in the third direction D3. It should be understood that the above-mentioned concave shape and convex shape that match each other only serve as an example and are not intended to limit the present disclosure. Since the first direction D1, the second direction D2, and the third direction D3 are linearly independent of one another, the connecting terminals 190 can be securely fixed when the degrees of freedom of the connecting terminals 190 in the first direction D1, the second direction D2, and the third direction D3 are all constrained at the same time.

As shown in FIG. 7 and FIG. 8, in the present embodiment, the top cover 180 has nut recesses 186 in it. The nut recesses 186 are used or accommodating nuts 187. Each of the connecting terminals 190 has a through hole 196 in it. When the nuts 187 are accommodated in the nut recesses 186, the third engaging portions 192 are engaged with the first engaging portions 183, and the second engaging portions 185 are engaged with the fourth engaging portions 194, threaded holes 188 of the nuts 187 are communicated with the through holes 196 of the connecting terminals 190.

At this time, an external electrical device can be screw tightened on the connecting terminals 190 through inserting screws (not shown in the figures) into the through holes 196 to screw-fit the nuts 187. The electrical connections between the connecting terminals 190 and the external electrical device are thus realized. Since the connecting terminals 190 are securely fixed and constrain positions of the nuts 187, the external electrical device is also allowed to be securely fixed through screw-fitting between the screws and the nuts 187. Not only is the fixing means easy to install, but the installation is also very firm. Especially, it is able to overcome the problem of falling off of the connecting terminals 190 caused by vibrations.

In one embodiment, the magnetic device 100 is a transformer. In another embodiment, the magnetic device 100 is an inductor. In still another embodiment, the magnetic device 100 is an integrated device constituted by a transformer and an inductor. In addition, the magnetic device 100 includes at least one coil. The bobbin includes at least one winding space. Each of the at least one winding space includes a coil wound in it. For example, in one embodiment, the magnetic device 100 is a transformer. The coil includes at least one primary side coil and at least one secondary side coil. The bobbin includes at least one first winding space and at least one second winding space. The primary side coil is wound in the first winding space. The secondary side coil is wound in the second winding space.

Figure 9:
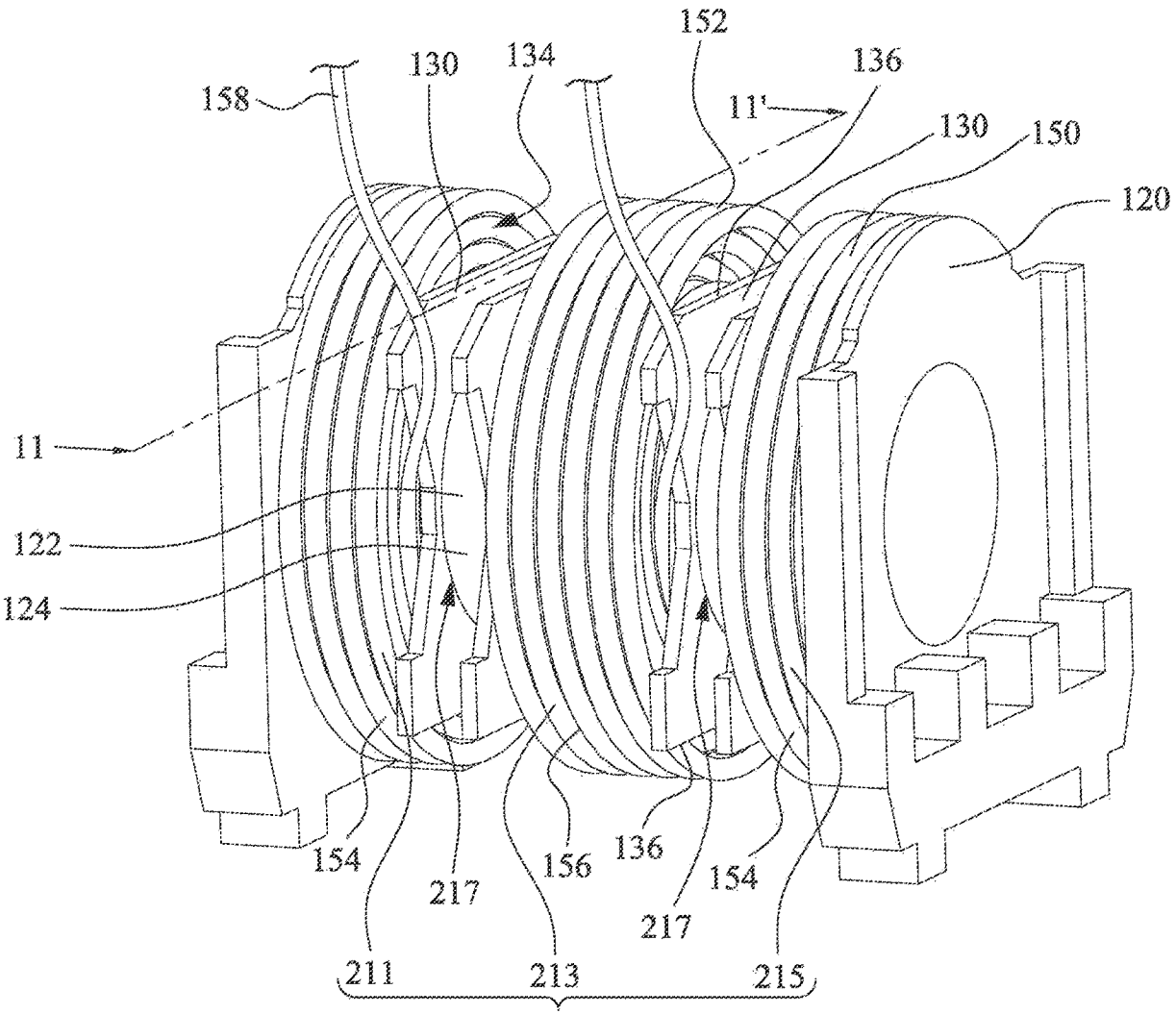
FIG. 9 depicts a perspective view of the bobbin and the coil in FIG. 2.

FIG. 9 depicts a perspective view of the bobbin 120 and the coil 150 in FIG. 2. According to the present embodiment, the magnetic device 100 is a transformer. The coil 150 includes two primary side coils 154 and one secondary side coil 156. The primary side coils 154 are used for inputting voltage and generating induced magnetic fields. The secondary side coil 156 is used for generating electric power output voltage based on the induced magnetic fields. The bobbin 120 includes a winding space 210. The winding space 210 includes a first winding space 211, a second winding space 213, and a third winding space 215 arranged in sequence. The secondary side coil 156 is wound in the second winding space 213. The two primary side coils 154 are wound respectively in the first winding space 211 and the third winding space 215. That is, the secondary side coil 156 is located between the two primary side coils 154. However, the present disclosure is not limited in this regard. One primary side coil may be located between two secondary side coils. Those of ordinary skill in the art may perform modifications and variations as required by practical needs.

Figure 10:
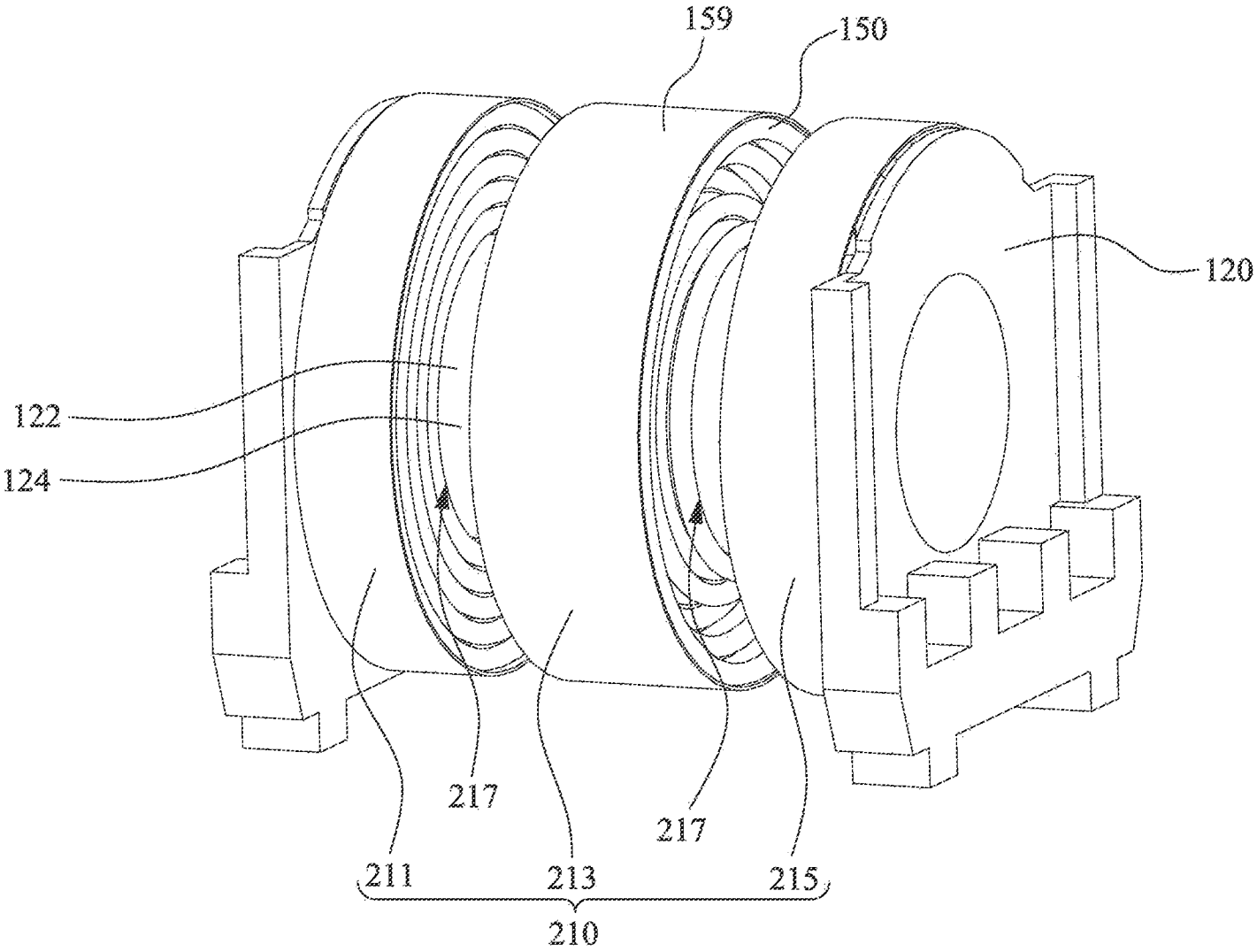
FIG. 10 depicts a perspective view of the bobbin and the coil in FIG. 2.

As shown in FIG. 9, the bobbin 120 includes the cylinder 122 and partition plates 130 according to the present embodiment. The cylinder 122 has a cylinder outer surface 124. The partition plates 130 stand on the cylinder outer surface 124 and are used for co-defining the winding space 210 with the cylinder outer surface 124 between the partition plates 130 and the cylinder outer surface 124. The coil 150 is wound in the winding space 210. In one embodiment, FIG. 10 depicts a perspective view of the bobbin 120 and the coil 150 in FIG. 2. The bobbin 120 includes the cylinder 122. The cylinder 122 has the cylinder outer surface 124. There is no partition plate on the cylinder outer surface 124. At least portions of the cylinder outer surface 124 define the winding space 210. In another embodiment, the bobbin 120 includes at least one winding space. In still another embodiment, the bobbin 120 includes at least two winding spaces. A heat conduction space 217 exists between the two winding spaces 210. In yet another embodiment, the partition plates 130 stand on the cylinder outer surface 124 and co-define the heat conduction spaces 217 with the cylinder outer surface 124 between the partition plates 130 and the cylinder outer surface 124, as shown in FIG. 9. In one embodiment, an area between the two winding spaces 211, 213 and an area between the two winding spaces 213, 215 define the heat conduction spaces 217 as shown in FIG. 10.

Figure 11:
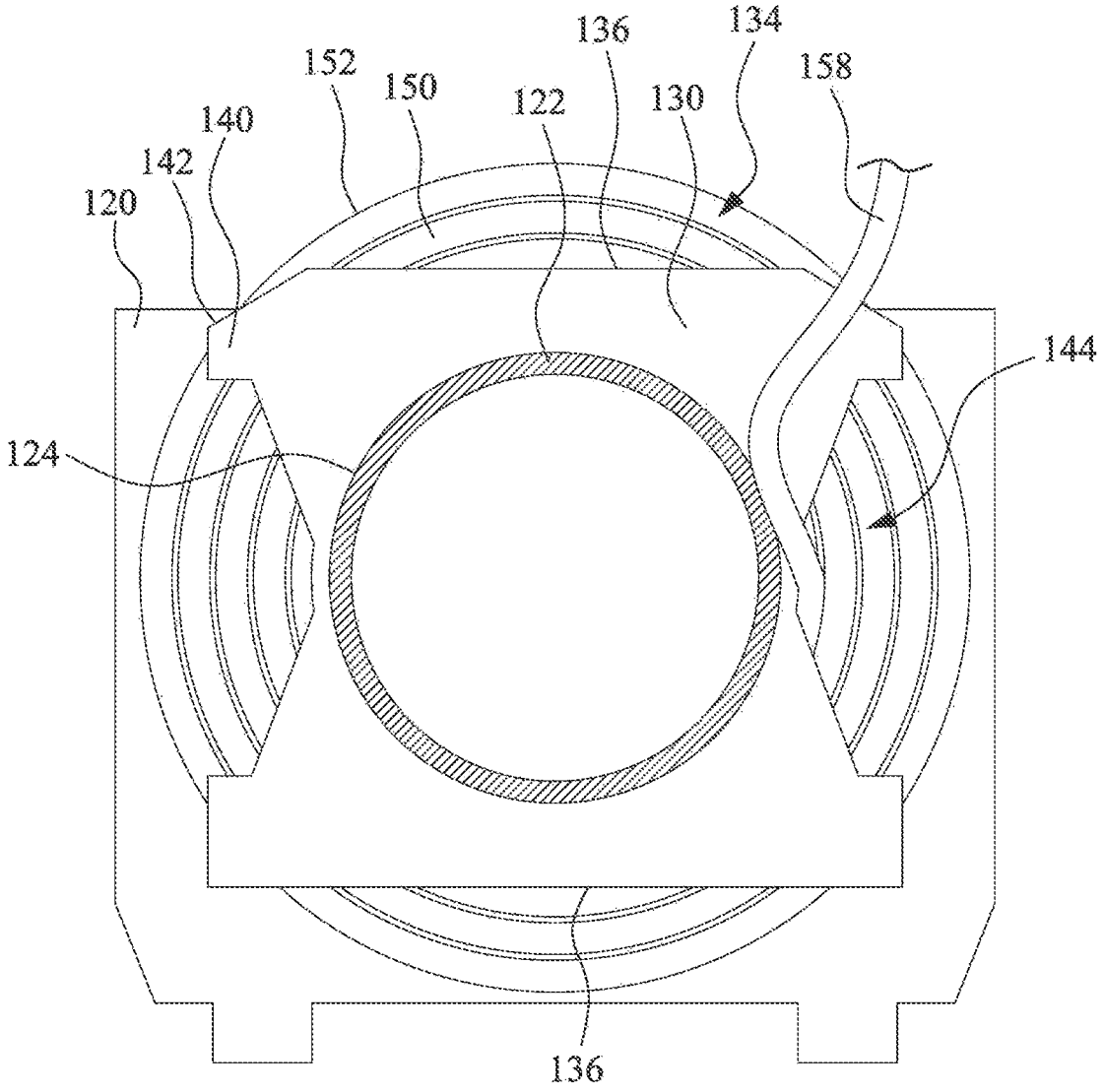
FIG. 11 depicts a cross-sectional view taken along line 11-11' of FIG. 9.

In one embodiment, a heat conduction medium is filled in the heat conduction spaces 217 so as to dissipate heat of the coil 150 in the winding space. In another embodiment, an area between the two winding spaces 210 defines the heat conduction space. The heat conduction medium thermally contacts the coils 150 directly so as to conduct heat generated by the coil 150 to the housing 110. In still another embodiment, the partition plates 130 co-define the heat conduction space with the cylinder outer surface 124 between the partition plates 130 and the cylinder outer surface 124. FIG. 11 depicts a cross-sectional view taken along line 11-11' of FIG. 9. The partition plate 130 has a heat conduction passage 134. The heat conduction passage 134 exposes at least one portion of the coil 150 so that the heat conduction medium, such as air flow, the heat conductive glue 170 (see FIG. 4), can thermally contact the coil 150 through the heat conduction passage 134 so as to conduct heat generated by the coil 150 and other components to the housing 110, and remove the heat through the heat dissipation device (not shown in the figure) connected to the outside of the housing 110. In addition, the heat conduction passage 134 is located on the partition plate 130 facing the side column. As shown in FIG. 2, the heat conduction passage 134 located on the partition plates 130 facing the side column 164 of the first magnetic core 160 and the side column of the second magnetic core 165 is used for facilitating heat dissipation of the coil. A conducting wire 158 electrically connected to the coil 150 does not pass the heat conduction passage 134.

In one embodiment, the heat conduction medium is a heat conductive glue. Since the heat conductive glue 170 (see FIG. 4) can thermally contact the coil 150 directly through the heat conduction passage 134, a heat quantity transferred from the coil 150 can be rapidly conducted to the housing 110 (see FIG. 2) through the heat conductive glue 170 because of heat conduction, and the heat is removed through the heat dissipation device (not shown in the figure) connected to the outside of the housing 110. As a result, the bobbin 120 according to the present embodiment has good heat dissipation ability.

In the present embodiment, the partition plate 130 has a partition edge 136 away from the cylinder outer surface 124. The coil 150 has the coil outer surface 152 away from the cylinder outer surface 124. A distance between at least portions of the coil outer surface 152 and the cylinder outer surface 124 is greater than a distance between the partition edge 136 and the cylinder outer surface 124, such that the heat conduction passage 134 exists between the coil outer surface 152 and the partition edge 136. In other words, the heat conduction passage 134 is not a hole in the partition plate 130 according to the present embodiment. Thus, the manufacturing process of the partition plate 130 is simpler.

In the present embodiment, each of the partition plates 130 has two partition edges 136. The partition edges 136 are flat surfaces, such that the manufacturing mold (not shown in the figure) may be designed to be released from both sides when the partition plate 130 is fabricated. Hence, the manufacturing cost of mold can be reduced, but the present disclosure is not limited in this regard. In other embodiments of the present disclosure, the partition edges 136 may be curved surfaces as long as the heat conduction passages 134 are able to expose at least portions of the coil 150.

In the present embodiment, the partition plate 130 includes support portions 140. Each of the support portions 140 has a support portion edge 142 away from the cylinder outer surface 124. A distance between the support portion edges 142 and the cylinder outer surface 124 is greater than or equal to a distance between the coil outer surface 152 and the cylinder outer surface 124. The support portions 140 are used for supporting the coil 150 to allow the coil 150 to be securely wound around the bobbin 120 without horizontal displacement.

The partition plate 130 further has an outlet recess 144 according to the present embodiment. The outlet recess 144 allows the conducting wire 158 electrically connected to the coil 150 to pass through. Not only does the outlet recess 144 make it convenient for the conducting wire 158 to be pulled out, but the heat conductive glue 170 (see FIG. 4) can also thermally contact the coil 150 directly through the outlet recess 144 so as to improve the heat dissipation efficiency of the coil 150.

According to the present embodiment, the outlet recess 144 is depressed toward the cylinder outer surface 124. Since the coil 150 is wound outwardly from the cylinder outer surface 124 one turn after another, the conducting wire 158 electrically connected to portions of the coil 150 closest to the cylinder outer surface 124 needs to be pulled out so as to electrically connect another electrical device (not shown in the figure). Hence, the more the outlet recess 144 is depressed toward the cylinder outer surface 124, the more convenient the conducting wire 158 can be pulled to an outside of the coil 150. In addition, the more the area of the coil 150 is exposed by the outlet recess 144, the larger the thermal contact area between the heat conductive glue 170 (see FIG. 4) and the coil 150 is, thus increasing the heat dissipation efficiency of the coil 150.

Figure 12:
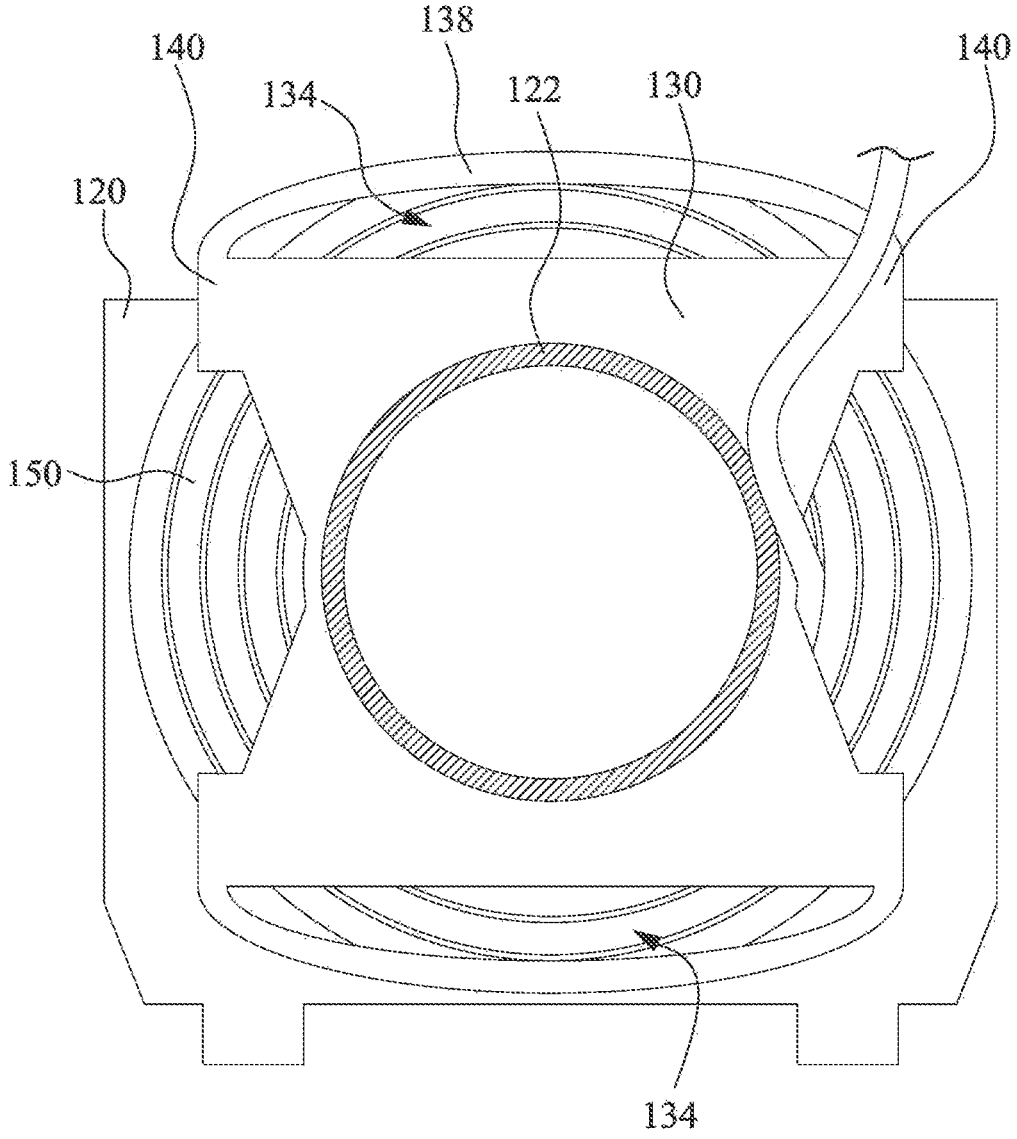
FIG. 12 depicts a cross-sectional view of a bobbin and a coil according to another embodiment of this disclosure.

FIG. 12 depicts a cross-sectional view of the bobbin 120 and the coil 150 according to another embodiment of this disclosure in which a cross-sectional position is the same as that in FIG. 11.

As shown in FIG. 12, in the present embodiment, the heat conduction passage 134 is holes in the partition plate 130. Under the circumstances, the partition plate 130 further includes support ribs 138 and each of the support ribs 138 is used for supporting two of the support portions 140 and the coil 150 so that the coil 150 can be better fixed.

A number of the heat conduction passages 134 is plural to improve the heat dissipation effect of the coil 150 according to the present embodiment. In FIG. 12, there are two heat conduction passages 134 and one is on the top and another is on the bottom. However, the present disclosure is not limited in this regard. Those of ordinary skill in the art may perform modifications and variations to the number of the heat conduction passages 134 as required.

Figure 13:
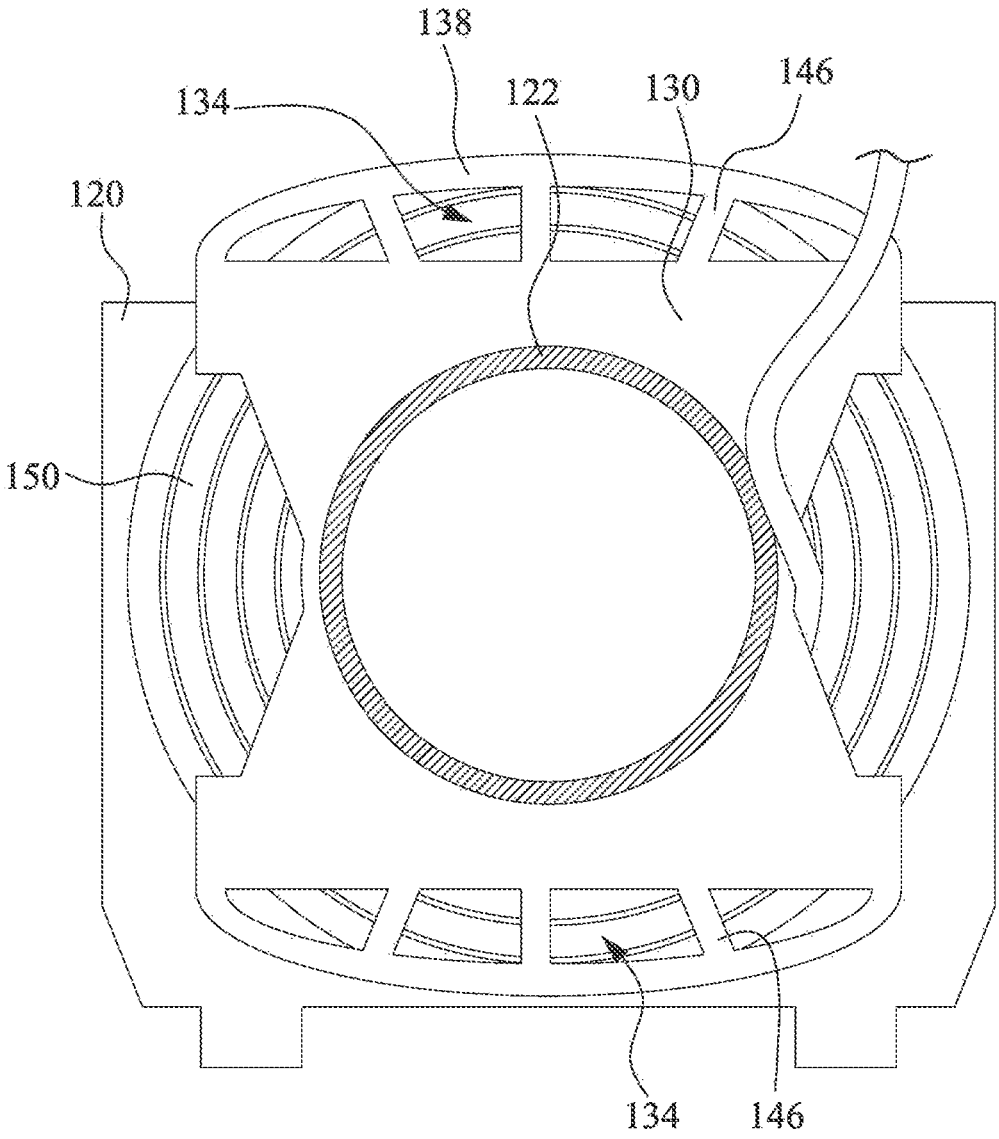
FIG. 13 depicts a cross-sectional view of a bobbin and a coil according to still another embodiment of this disclosure.

FIG. 13 depicts a cross-sectional view of the bobbin 120 and the coil 150 according to still another embodiment of this disclosure in which a cross-sectional position is the same as that in FIG. 11.

As shown in FIG. 13, in the present embodiment, the partition plate 130 further includes supports 146 crossing the heat conduction passages 134 to enhance strength of the support ribs 138, such that the support ribs 138 are not easy to fracture due to thermal expansion.

A number of the heat conduction passages 134 is plural (In FIG. 13 one heat conduction passage 134 is on the top and another heat conduction passage 134 is on the bottom, but the present disclosure is not limited in this regard) according to the present embodiment. Each of the heat conduction passages 134 has a plurality of supports 146. Hence, the coil 150 is able to dissipate heat through the plurality of heat conduction passages 134. At the same time, the plurality of supports 146 can securely fixed the coil 150 to avoid the horizontal displacement of the coil 150 caused by the vibrations of the magnetic device 100. However, in other embodiments, the number of the heat conduction passages 134 and a number of the supports 146 may be any number.

In one embodiment, the magnetic core engaging with the above-mentioned bobbins may be a magnetic core in any shape, such as a U-shaped magnetic core, an E-shaped magnetic core, as long as the heat conduction passage in the bobbin is located on the partition plate of the bobbin facing the side column of the magnetic core.

Figure 14:
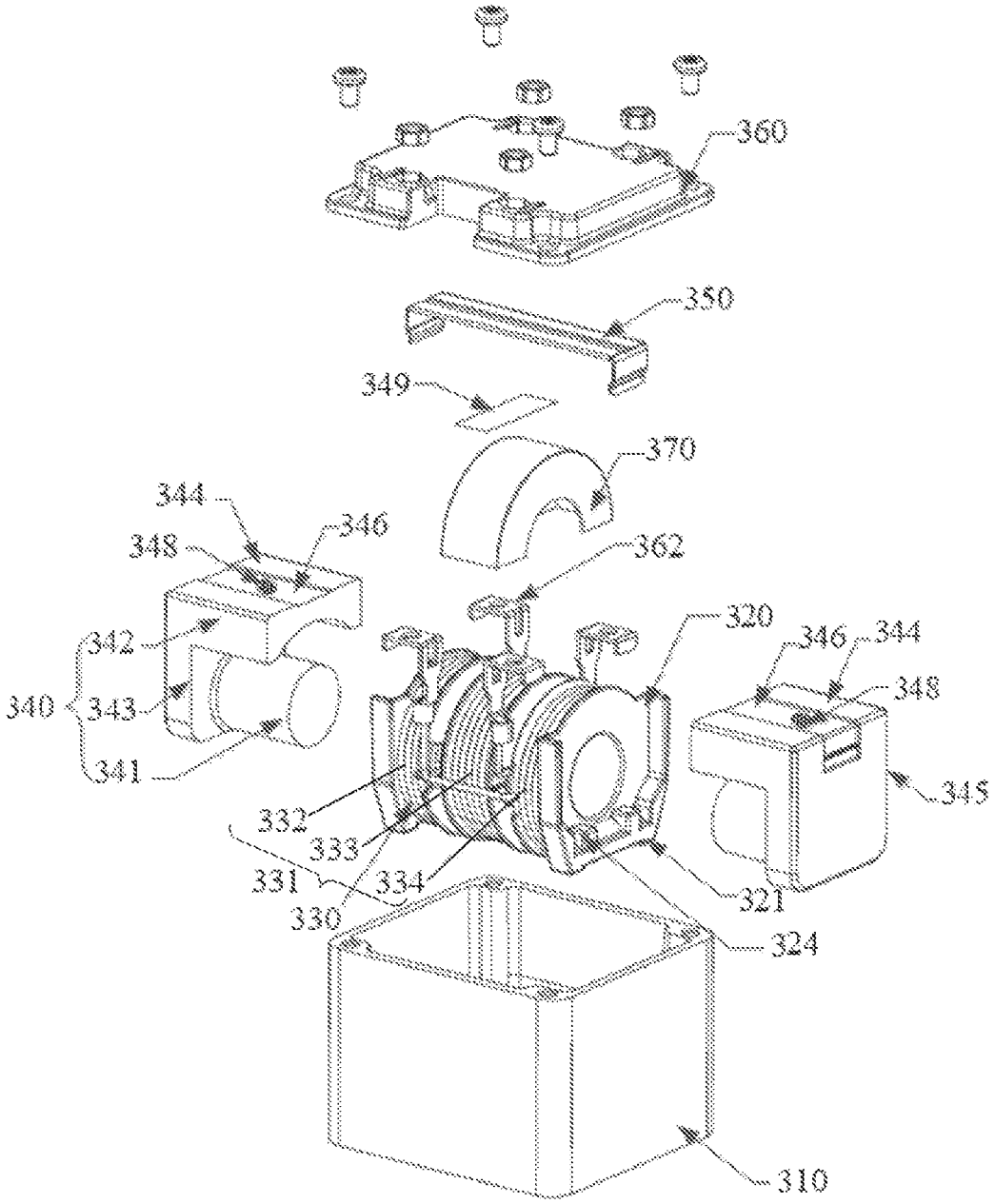
FIG. 14 depicts an exploded view of a magnetic device according to yet another embodiment of this disclosure.
Figure 15:
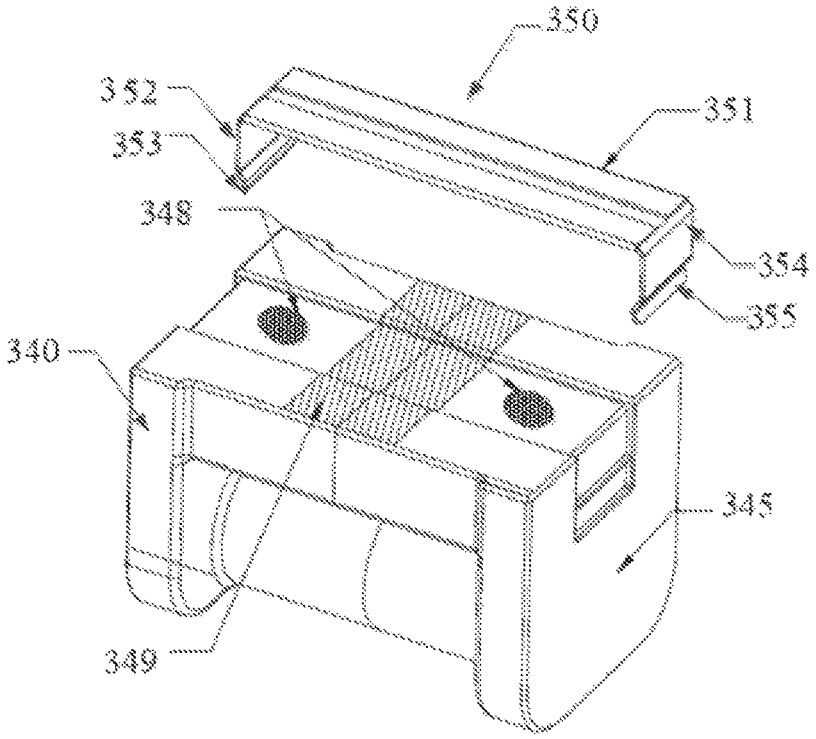
FIG. 15 is a structure diagram depicting an arrangement of fixing glue and adhesive tape provided between a metal clip and an accommodating groove of a side column according to yet another embodiment of this disclosure.
Figure 16:
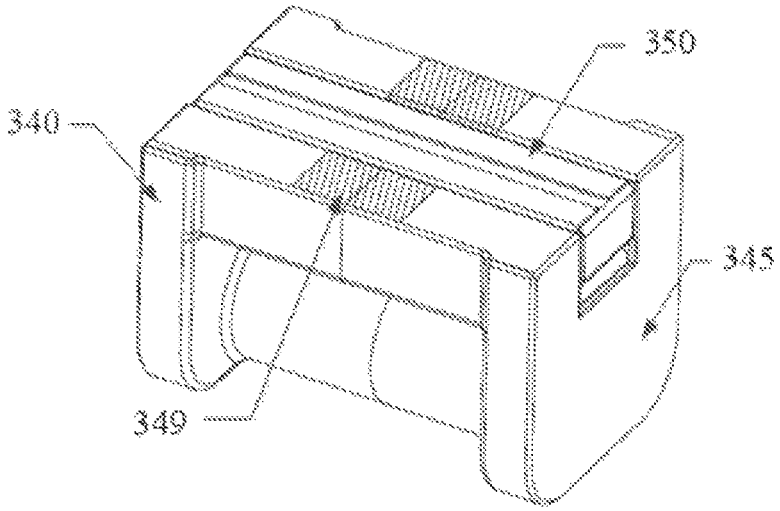
FIG. 16 is a structure diagram depicting a configuration that the metal clip and the accommodating groove of the side column in FIG. 15 have been engaged.

In this embodiment, as shown in FIGS. 14-17, detailed description for the components similar to those shown in FIGS. 2-5 is omitted. A metal clip 350 is further introduced in the magnetic device to fasten the two magnetic cores fitting with each other, in order to avoid the magnetic cores from being broken by compression resulting from other components during the operation process, and thus the reliability of the magnetic device can be improved. The metal clip 350 is provided at outer side surfaces 344 for clamping the two magnetic cores so as to fit the first and second magnetic cores 340, 345 together. An accommodating groove 346 for accommodating the metal clip 350 may be provided in the outer side surfaces 344 of the two side columns, the accommodating groove 346 is configured to position the metal clip 350 to make it more inosculate on the outer side surfaces 344. Moreover, a fixing glue 348 may be provided between the metal clip 350 and the accommodating groove 346 in order to fasten the metal clip more stably within the accommodating groove 346. As illustrated in FIG. 15, the fixing glue 348 may be arranged on both side columns of the two magnetic core such that the first and second magnetic cores 340, 345 are positioned with the metal clip 350 by means of the fixing glue. In other embodiments, the fixing glue 348 may be provided on one of the first and second magnetic cores 340, 345, the present embodiment is not intended to limit the position of the fixing glue in any way. The configuration that the metal clip 350 being engaged within the accommodating groove 346 is shown in FIG. 16.

Further, as illustrated in FIGS. 15-16, the metal clip 350 may include a connecting piece 351, a first bent piece 352 and a second bent piece 354. The connecting piece 351 is a part of the metal clip 350 that is arranged at the accommodating groove 346 of the side column, the first bent piece 352 is an extension part of the connecting piece 351 that is bent towards the connecting portion of the first magnetic core 340 away from the side column, and the second bent piece 354 is an extension part of the connecting piece 351 that is bent towards the connecting portion of the second magnetic core 345 away from the side column. In order to better fasten the first bent piece 352 and the second bent piece 354 onto the respective connecting portions, a first engaging portion 353 is provided at the end of the first bent piece 352, with an engaging groove being provided at the connecting portion of the first magnetic core 340 for engaging with the first engaging portion 353. Similarly, a second engaging portion 355 is provided at the end of the second bent piece 354, with an engaging groove being provided at the connecting portion of the second magnetic core 345 for engaging with the second engaging portion 355. Each of the first engaging portion 353 and the second engaging portion 355 may be a flange fitting with the step(s) of the engaging groove, or may be any other mechanism that can implement the engagement, and the present embodiment is not intended to form any specific limitation in this respect. Besides, as illustrated in FIGS. 15 and 16, In order to prevent the fixing glue from seeping into the junction of the first and second magnetic cores 340, 345, an adhesive tape 349 may be further provided at a junction of the first and second magnetic cores 340 and 345 so as to implement an effective physical isolation between the fixing glue 348 and the junction of the two magnetic cores. Furthermore, the adhesive tape 349 is arranged between the metal clip 350 and the side columns.

In this embodiment, the metal clip 350 is required to have a certain rigidity and toughness, and thus the metal clip 350 can be made of stainless steel material.

As shown in FIG. 14, the bobbin of the transformer comprises at least one primary winding space and at least one secondary winding space, and the coil 330 comprises at least one primary side coil and at least one secondary side coil, wherein the at least one primary side coil is wound in the at least one primary winding space, and the at least one secondary side coil is wound in the at least one secondary winding space. In some embodiments, the bobbin comprises a first winding space 332, a second winding space 333, and a third winding space 334 arranged in sequence, the coil 330 comprises two primary side coils and one second side coil, wherein the secondary side coil is wound in the second winding space 333 as the secondary winding space, and the two primary side coils are wound respectively in the first winding space 332 and the third winding space 334 as the primary winding space. In some embodiments, the bobbin comprises a first winding space 332, a second winding space 333, and a third winding space 334 arranged in sequence, wherein the coil comprises one primary side coil and two secondary side coils, the primary coil is wound in the second winding space 333 as the primary winding space, and the two secondary side coils are wound respectively in the first winding space 332 and the third winding space 334 as the secondary winding space.

Figure 17:
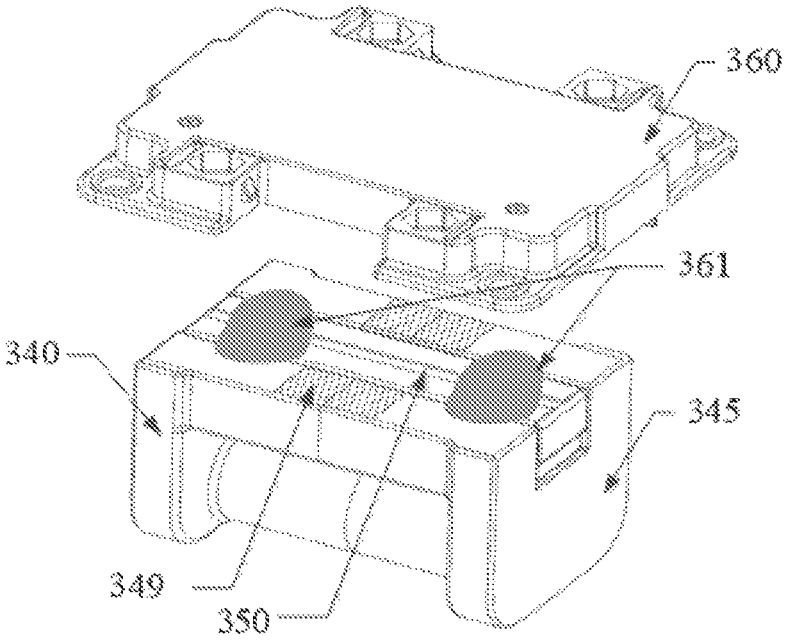
FIG. 17 is a structure diagram depicting an arrangement of fixing glue provided between a top cover and an assembly surface according to yet another embodiment of this disclosure.

As illustrated in FIGS. 14 and 17, the magnetic device further comprises a top cover 360, the top cover 360 is configured to cover the housing 310 and is arranged on the opposite side to the bottom plate. After the metal clip 350 was arranged within the accommodating groove 346 of the side column, the side columns form an assembly surface together with the metal clip 350, and a fixing glue 361 is provided between the top cover 360 and the assembly surface so that the two parts can be fixedly connected to integrate the magnetic device and the top cover into one unit. The magnetic device may further comprise at least a connecting terminal 362, as shown in FIG. 14. The number of the connecting terminal 362 can be two or more, the connecting terminal 362 may be fixed to the top cover 360 and electrically connected to the coil 330.

Figure 18:
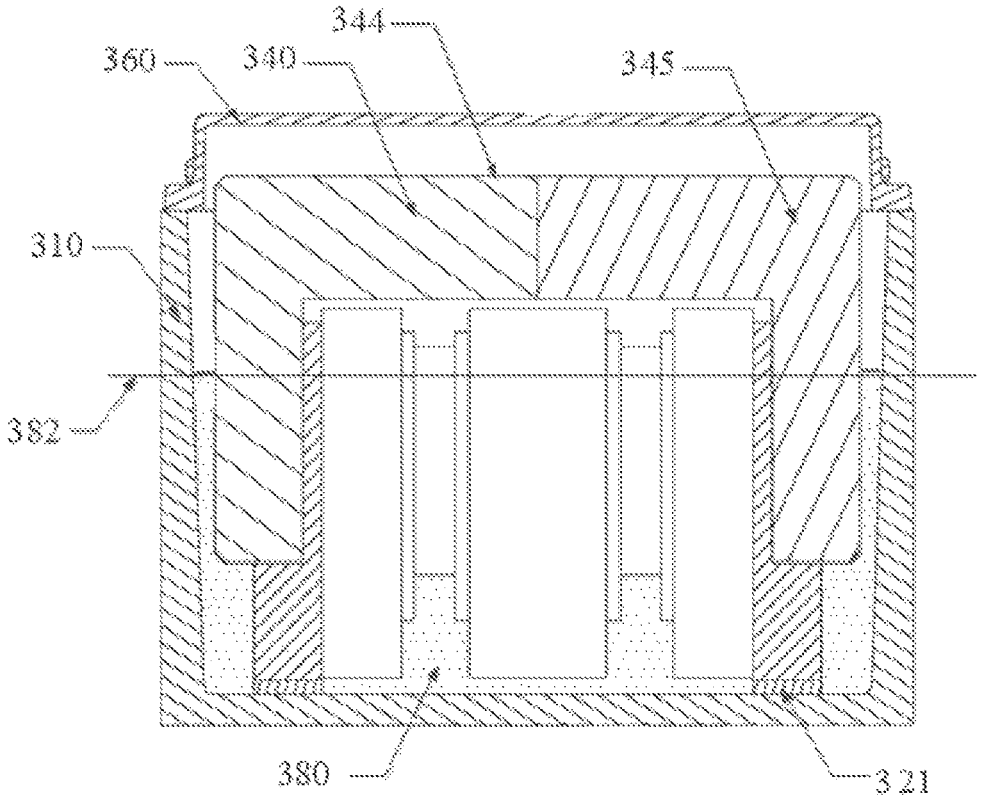
FIG. 18 depicts a cross-sectional diagram of a magnetic device according to yet another embodiment of this disclosure.

In one embodiment, as illustrated in FIG. 18, a fluid level 382 of heat conductive glue may be lower than an upper surface formed by the coil 330 being wound around the bobbin 320 adjacent to the magnetic core side column. The term "fluid level 382 of heat conductive glue" refers to the farthest surface of the heat conductive glue with respect to the bottom plate. The advantage of such an arrangement is that even if the heat conductive glue 380 has expanded under heating, it will not squeeze the side column to cause the side column break. In addition, since a portion of the coil 330 facing the bottom plate is not restrained by the magnetic core, when the magnetic device is warming up due to operation, the magnetic core will be forced to displace at the most, without being damaged or broken by compression.

Figure 19:
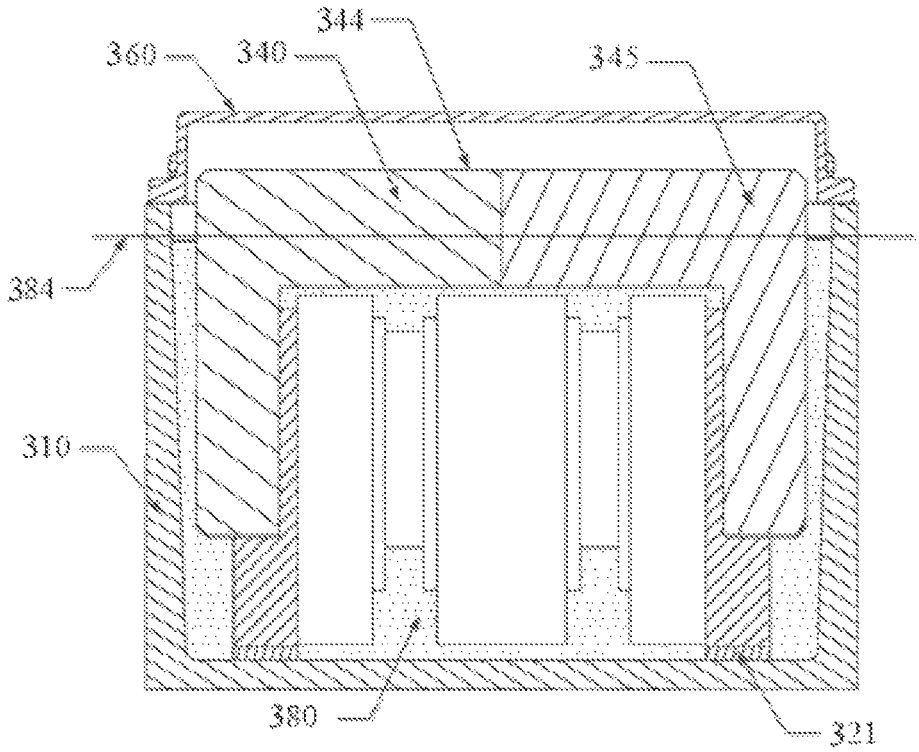
FIG. 19 depicts a cross-sectional diagram of a magnetic device according to another embodiment of this disclosure.
Figure 20:
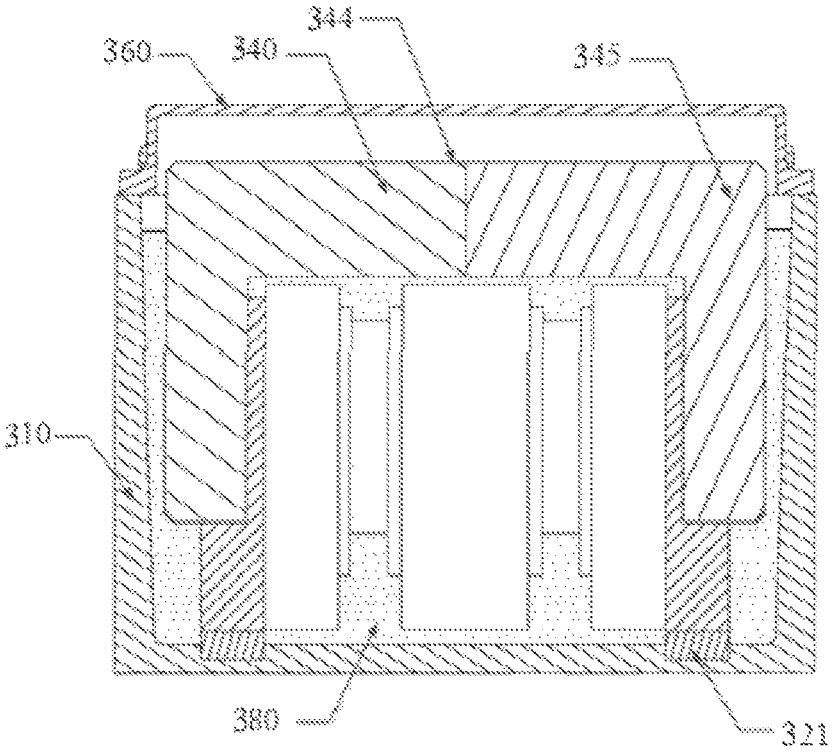
FIG. 20 depicts a cross-sectional diagram of a magnetic device according to still another embodiment of this disclosure.

Furthermore, because the metal clip 350 is further introduced in this disclosure to fasten the two magnetic cores fitting with each other, a further optimization of heat dissipation of the magnetic device can be achieved while ensuring that the two magnetic cores will not be broken by compression resulting from other components (e.g., the glue body) during the operation process. In this disclosure, the embodiment as shown in FIG. 18 is further optimized to thereby provide another embodiment, as shown in FIG. 19, in which the space formed by the first magnetic core 340, the second magnetic core 345 and the housing 310 may be filled with heat conductive glue 380. In the present embodiment, a fluid level 382 of heat conductive glue may be higher than an inner surface formed by the first and second magnetic cores 340, 345 facing the bobbin, and lower than an edge of the housing side plate facing the top cover 360. In comparison with the fluid level 382 of heat conductive glue of the embodiment shown in FIG. 18, the fluid level 384 of heat conductive glue of the embodiment shown in FIG. 19 is raised above the an inner surface formed by the first and second magnetic cores 340, 345 facing the bobbin, such that the main heat dissipation component coil 330 and the space around the same are completely within the space of heat conductive glue, the area the heat conductive glue contacting the coil 330 and other component(s) is increased, and thus the advantageous effect resulting therefrom is that the thermal energy generated from coil 330 and other component(s) can be directed more to the housing 310, so that the heat dissipation efficiency is improved and the reliability of the magnetic device is further increased.

In this embodiment, one or more coils 330 are arranged axially at interval along the cylinder body of the bobbin 320, in order to make each of the coils have more sufficient heat dissipation and working effect. As illustrated in FIG. 14, the number of the coils can be three. In other embodiments, the number of the coils can be four, five or more, this disclosure is not intended to be limited in this regard. Further, for the sake of safety regulation, an insulating cap 370 may be provided onto each of the one or more coils 330, the insulating cap 370 can be arranged between each coil and the inner surface of the side column.

In this embodiment, the other components identical to those in FIGS. 1-5, such as the protruding member, the abutment portion or the like, as well as the magnetic core configuration identical to that of FIG. 6 will not be described any more.

Figure 21:
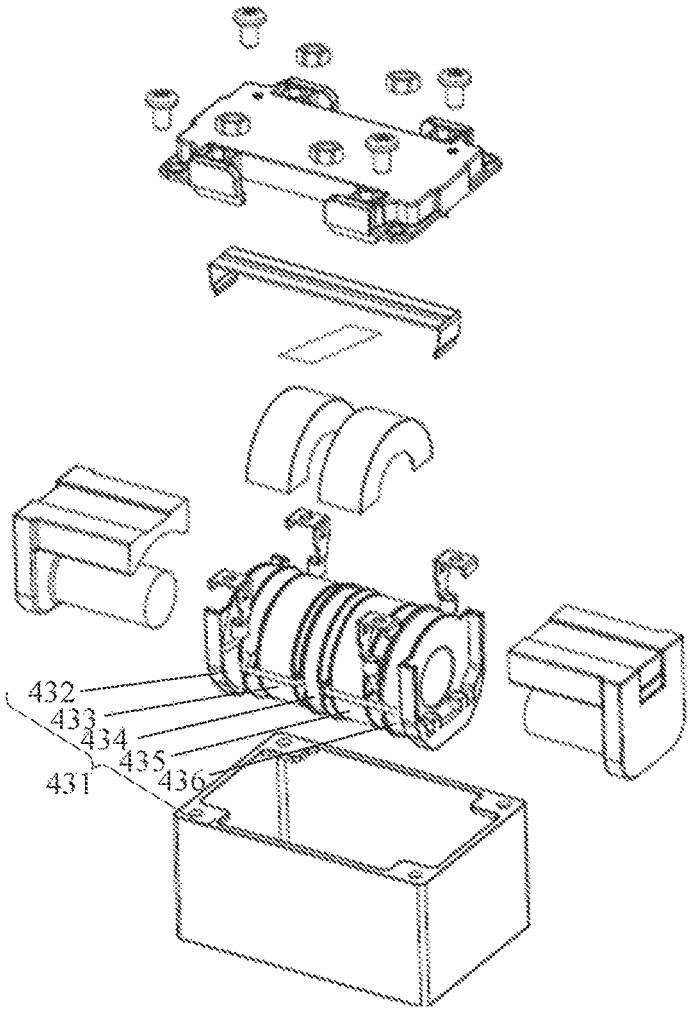
FIG. 21 depicts an exploded view of a magnetic device according to another embodiment of this disclosure.

FIG. 21 depicts an exploded view of a magnetic device according to another embodiment of this disclosure.

Similar to the embodiment as shown in FIG. 14, the bobbin of transformer comprises a first winding space 432, a second winding space 433, a third winding space 434, a fourth winding space 435, and a fifth winding space 436 arranged in sequence. The coil comprises three primary side coils and two secondary side coils. In an exemplary embodiment, the three primary side coils may be wound respectively in the first winding space 432, the third winding space 434 and the fifth winding space 436, and the two secondary side coils may be wound respectively in the second winding space 433 and the fourth winding space 435. In alternative embodiment, the coil comprises two primary side coils and three secondary side coils, and the two primary side coils may be wound respectively in the second winding space 433 and the fourth winding space 435, and the three secondary side coils may be wound respectively in the first winding space 432, the third winding space 434 and the fifth winding space 436.

According to the second aspect of this disclosure, an electronic equipment is provided, which comprises at least the aforementioned magnetic device.

As for an electronic equipment in the present exemplary embodiment, the advantageous effect thereof has been described in details in connection with the included magnetic device as mentioned above, and thus repetitive description will be omitted here.

In summary, according to the magnetic device of the above embodiments, the portion of the coil facing the bottom plate of the housing can transfer heat to the housing directly and the heat is dissipated through the heat dissipation device connected to the outside of the housing. Hence, the magnetic device according to the above embodiments has good heat dissipation ability. Additionally, since the portion of the coil facing the bottom plate is not constrained by the magnetic cores, the magnetic cores at most are displaced rather than are fractured or are damaged because of being squeezed when the temperature of the magnetic device rises during operation.

In addition, the bobbin of the magnetic device according to the above embodiments further has the heat conduction passage. Hence, the heat conduction medium can thermally contact the coil directly through the heat conduction passage so as to rapidly conduct the heat and transferred from the coil to the housing through the heat conduction medium because of heat conduction. As a result, the bobbin according to the above embodiments has good heat dissipation ability.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A magnetic device comprising: a housing having at least one side plate and a bottom plate, the side plate standing on the bottom plate and forming a space with the bottom plate; a bobbin at least partially located in the space, the bobbin having a cylinder; at least one coil wound around the cylinder; and a first magnetic core and a second magnetic core, each of the first and second magnetic cores comprising:

a center column located in the cylinder; a side column located on an outer side of the coil being opposite to the bottom plate, such that the coil is located between the side column and the bottom plate; and a connecting portion connecting the center column and the side column, wherein the first magnetic core and the second magnetic core are arranged on two sides of the bobbin, respectively, and the side column of the first magnetic core and the side column of the second magnetic core form an outer side surface at a side away from the bobbin; a metal clip provided at the outer side surfaces for tightening the first magnetic core and the second magnetic core so that the first and second magnetic cores fit together; wherein accommodating grooves for holding the metal clip are provided in the side columns, the metal clip is arranged in the accommodating grooves of the side columns, and a fixing glue is provided between the metal clip and the accommodating grooves of the side columns; and a top cover is configured to cover the housing and arranged on the opposite side to the bottom plate, the outer side surfaces of the side columns form an assembly surface together with the metal clip, and another fixing glue is provided between the top cover and the assembly surface, the assembly surface and the top cover are glued and fixed by the another fixing glue.

2. The magnetic device of claim 1, further comprising:

a heat conductive glue potted into the space at a level lower than the outer side surface formed by the side column of the first magnetic core and the side column of the second magnetic core at the side away from the bobbin.

3. The magnetic device of claim 1, further comprising:

at last one protruding member disposed on the bobbin, the at least one protruding member abutting the bottom plate, wherein the coil has a coil outer surface, and a spacing exists between the coil outer surface and the bottom plate.

4. The magnetic device of claim 1, further comprising:

at last one protruding member disposed on the bobbin, wherein the bottom plate is provided with at least one positioning recess thereon, and the protruding member is engaged with the positioning recess.

5. The magnetic device of claim 1, further comprises:

at least a connecting terminal electrically connected to the coil.

6. The magnetic device of claim 1, wherein the coil has a coil outer surface, a spacing exists between the coil outer surface and the bottom plate.

7. The magnetic device of claim 1, wherein the magnetic device is a transformer, the bobbin comprises at least one primary winding space and at least one secondary winding space, the coil comprises at least one primary side coil and at least one secondary side coil, wherein the at least one primary side coil is wound in the corresponding primary winding space, and the at least one secondary side coil is wound in the corresponding secondary winding space.

8. The magnetic device of claim 1, wherein the magnetic device is a transformer, the bobbin comprises a first winding space, a second winding space, and a third winding space arranged in sequence, the coil comprises two primary side coils and one second side coil, wherein the secondary side coil is wound in the second winding space, and the two primary side coils are wound respectively in the first winding space and the third winding space.

9. The magnetic device of claim 1, wherein the magnetic device is a transformer, the bobbin comprises a first winding space, a second winding space, and a third winding space arranged in sequence, wherein the coil comprises one primary side coil and two secondary side coils, the primary coil is wound in the second winding space, and the two secondary side coils are wound respectively in the first winding space and the third winding space.

10. The magnetic device of claim 1, wherein the magnetic device is a transformer, the bobbin comprises a first winding space, a second winding space, a third winding space, a fourth winding space, and a fifth winding space arranged in sequence, wherein the coil comprise three primary side coils and two secondary side coils, the three primary side coils are wound respectively in the first winding space, the third winding space and the fifth winding space, the two secondary side coils are wound respectively in the second winding space and the fourth winding space.

11. The magnetic device of claim 1, wherein the magnetic device is a transformer, the bobbin comprises a first winding space, a second winding space, a third winding space, a fourth winding space, and a fifth winding space arranged in sequence, wherein the coil comprise two primary side coils and three secondary side coils, the two primary side coils are wound respectively in the second winding space and the fourth winding space, the three secondary side coils are wound respectively in the first winding space, the third winding space and the fifth winding space.

12. The magnetic device of claim 1, wherein the coil has a portion facing the bottom plate, and the portion of the coil facing the bottom plate is not covered by the first and second magnetic cores.

13. The magnetic device of claim 1, wherein the side column is in an arcuate shape, in a circular shape, in a square shape, in a rectangular shape, in a trapezoidal shape, in an elliptical shape, in an irregular shape, or in a shape of combinations thereof.

14. The magnetic device of claim 1, wherein the center column is in a circular shape, in a semicircular shape, in a square shape, in a rectangular shape, in a trapezoidal shape, in an elliptical shape, in an irregular shape, or in a shape of combinations thereof.

15. The magnetic device of claim 1, wherein the metal clip comprises:

a connecting piece arranged across the accommodating grooves of the side columns and extending towards the directions of the connecting portions of the first and second magnetic cores, respectively; a first bent piece, which is configured to be an extension part of the connecting piece that is bent towards the connecting portion of the first magnetic core; and a second bent piece, which is configured to be an extension part of the connecting piece that is bent towards the connecting portion of the second magnetic core.

16. The magnetic device of claim 15, wherein an adhesive tape is provided between the metal clip and the side columns, the adhesive tape is arranged on the outer side surface formed by the side column of the first magnetic core and the side column of the second magnetic core at the side away from the bobbin, and covers a junction of the first and second magnetic cores, so as to prevent the fixing glue from seeping into the junction.

17. The magnetic device of claim 16, wherein a first engaging portion is provided at an end of the first bent piece of the metal clip, with an engaging groove being provided at the connecting portion of the first magnetic core for engaging with the first engaging portion; and a second engaging portion is provided at the end of the second bent piece of the metal clip, with an engaging groove being provided at the connecting portion of the second magnetic core for engaging with the second engaging portion.

18. The magnetic device of claim 17, wherein the metal clip is made of stainless steel.

19. The magnetic device of claim 16, wherein one or more coils are arranged axially at interval along the cylinder body of the bobbin.

20. The magnetic device of claim 19, further comprising: at least an insulating cap arranged between the coil and the inner surface of the side column, the cap being provided over at least one of the coils.

* * * * *